US008122522B2

(12) United States Patent
Looft

(10) Patent No.: US 8,122,522 B2
(45) Date of Patent: Feb. 28, 2012

(54) TOLIET DOSING DISPENSER

(75) Inventor: Jan Looft, Holzminden (DE)

(73) Assignee: Symrise AG, Holzminden (DE)

( * ) Notice: Subject to any disclaimer, the term of this patent is extended or adjusted under 35 U.S.C. 154(b) by 1022 days.

(21) Appl. No.: 11/576,775

(22) PCT Filed: Oct. 6, 2005

(86) PCT No.: PCT/EP2005/055060

§ 371 (c)(1),
(2), (4) Date: Jan. 23, 2008

(87) PCT Pub. No.: WO2006/040293

PCT Pub. Date: Apr. 20, 2006

(65) Prior Publication Data

US 2008/0244813 A1 Oct. 9, 2008

(30) Foreign Application Priority Data

Oct. 7, 2004 (DE) ..... 10 2004 049 138
Jan. 13, 2005 (DE) ..... 10 2005 001 794

(51) Int. Cl.
*E03D 9/02* (2006.01)

(52) U.S. Cl. ..... 4/223; 4/229; 4/230; 4/470; 422/263; 220/87.1

(58) Field of Classification Search ..... 4/223, 229, 4/230, 232, 222, 470, 459; 422/263–266; 222/23, 437, 457; 220/87.1
See application file for complete search history.

(56) References Cited

U.S. PATENT DOCUMENTS 298,091 A * 5/1884 Hubbard ..... 4/230
(Continued)

FOREIGN PATENT DOCUMENTS

DE 101 23 201 1/2002
(Continued)

*Primary Examiner* — Steven J Ganey
(74) *Attorney, Agent, or Firm* — Roylance, Abrams, Berdo & Goodman, L.L.P.

(57) ABSTRACT

The invention relates to metering dispensers for release of a product into a WC bowl of a toilet, comprising a fixing region which is constructed in order to fix the metering dispenser in the region of the toilet, in particular under a WC lid, and a storage container for accommodating the product. Such metering dispensers have the problem that the product can be metered only inaccurately and not very variably. This problem is solved according to the invention in that the storage container is constructed for accommodation of pre-portioned products and a delivery device which is constructed in order to deliver at least one pre-portioned product from the storage container into the WC bowl is provided.

48 Claims, 20 Drawing Sheets

U.S. PATENT DOCUMENTS

Figure 1:
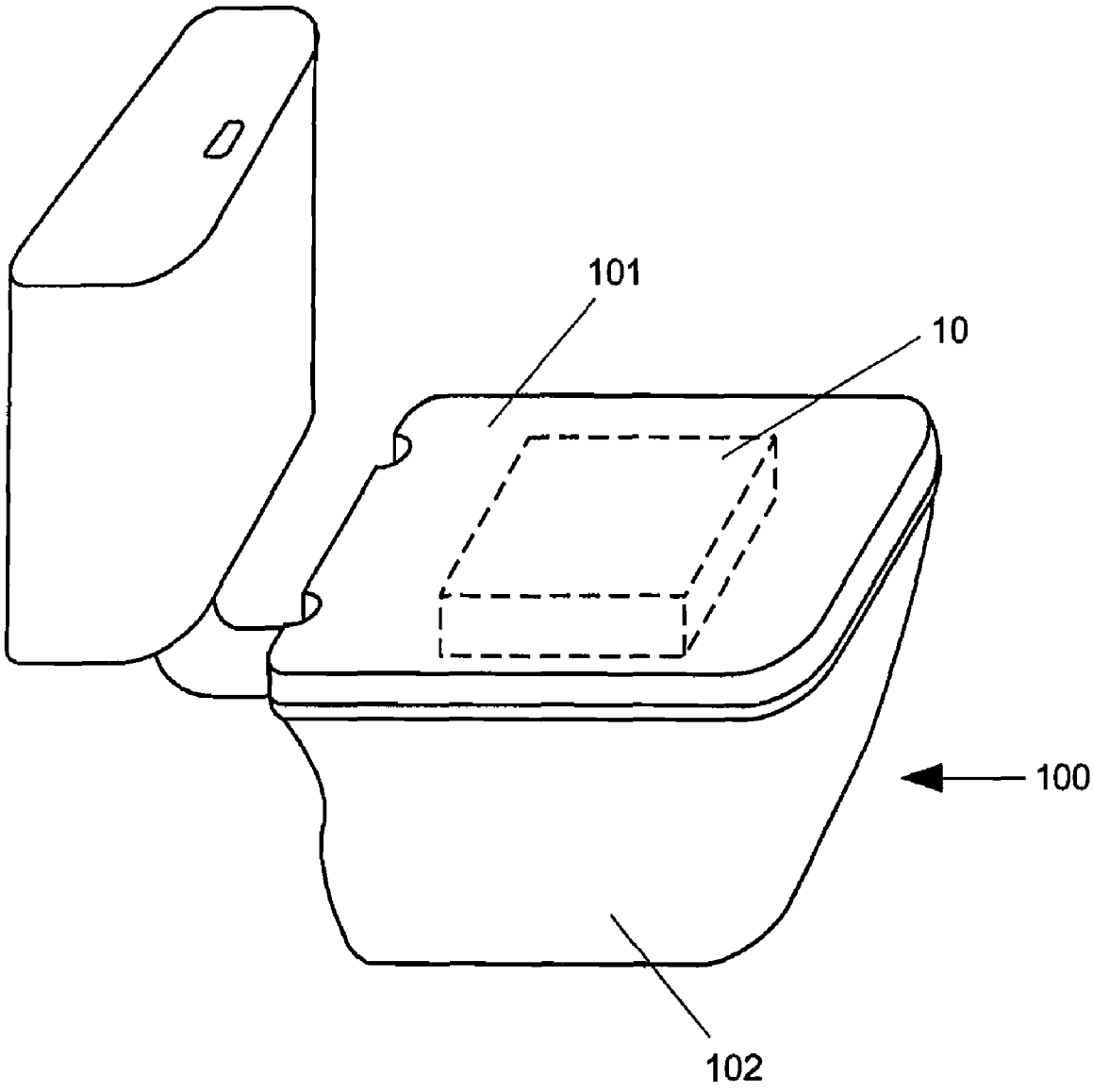

| | | | | | |
|---|---|---|---|---|---|
| 412,273 | A | * | 10/1889 | Kinney | 220/87.1 |
| 658,982 | A | * | 10/1900 | Fischer | 4/230 |
| 713,978 | A | * | 11/1902 | Gallagher | 4/223 |
| 749,963 | A | * | 1/1904 | Gallagher | 4/223 |
| 979,386 | A | * | 12/1910 | Druzbach | 4/230 |
| 2,950,959 | A | | 8/1960 | Relle | |
| 3,840,914 | A | | 10/1974 | Tufts | |

FOREIGN PATENT DOCUMENTS

| | | |
|---|---|---|
| DE | 102 46 581 | 10/2003 |
| EP | 1 505 215 | 2/2005 |

* cited by examiner

TOLIET DOSING DISPENSER

FIELD OF THE INVENTION

The invention relates to a metering dispenser for release of a product into a WC bowl of a toilet, comprising a fixing region which is constructed in order to fix the metering dispenser in the region of the toilet, in particular under a WC lid, and a storage container for accommodating the product. A further aspect of the invention is a lid for a toilet, having a metering dispenser fixed thereto, and a toilet having a metering dispenser fixed thereon. Finally, a further aspect of the invention is a method for hygienic treatment of toilets, in particular for cleaning, disinfecting and/or eliminating odour, with the step of release of an active compound from a storage container into the WC bowl.

BACKGROUND OF THE INVENTION

It is known, for the purpose of cleaning, disinfecting and for improving fragrance in toilets or for colouring or prevention of colouring in the region of WC bowls, to meter an active compound, such as, for example, a cleaning agent, a disinfectant or a fragrance, optionally mixed with a dyestuff, into a WC bowl. It is thus known, for example, from U.S. Pat. No. 1,510,111 to provide, in a closing lid of a toilet with a faeces storage unit, a hollow cavity which is filled with a liquid disinfectant and from which this disinfectant is released into the faeces storage unit with the aid of a metering device. Devices of this type are known for toilets which are not connected to the sewerage system, in order to ensure at least a minimum of hygiene.

It is furthermore known to fix a substantially solid product in a cage on the edge of a WC bowl, some of this solid product being dissolved in liquid form by the flushing water during each flushing operation of the toilet and arriving in the WC bowl.

One disadvantage of the known metering dispensers is that either a liquid active compound is used, which is difficult to stockpile and topping up of which is unpleasant, especially in the hygienically sensitive toilet region, or a solid active compound is used, which, however, can be metered only inaccurately because of the dependence of the dissolving action of the flushing water on the surface of the active compound product.

A further disadvantage of known metering dispensers is that only one active compound product can be metered in, which, however, because of the nowadays increased toilet hygiene requirements, is often not sufficient to meet all odour, hygiene and appearance demands.

Finally, a further disadvantage of the known device is that because the metering is limited to either liquid or solid active compounds in each of the known devices, there is in each only a low variability in the choice of active compounds metered in, in particular the state of aggregation thereof.

SUMMARY OF THE INVENTION

The invention was based on the object of providing a metering dispenser which at least reduces one of the abovementioned problems, or in the best case avoids it.

DETAILED DESCRIPTION OF THE INVENTION

This object is achieved in an abovementioned metering dispenser in that the storage container is constructed for accommodation of pre-portioned products, and a delivery device which is constructed in order to deliver at least one pre-portioned product from the storage container into the WC bowl is provided.

The invention overcomes a number of disadvantages of the known metering dispensers in that it is constructed in order to store and to deliver pre-portioned products. These pre-portioned products can be on the one hand tablets, pellets or similar products in solid form, or they can be liquid or gaseous active compounds or active compound mixtures which are enclosed in a solid shell and are then released by dissolving of the solid shell, for example on contact with water. In this manner, the metering dispenser according to the invention renders it possible on the one hand to use and meter a very large number of different active compounds, and moreover to store several pre-portioned products with different active compounds in the storage container and consequently to deliver the different active compounds from the storage container into the WC bowl in a successive manner with respect to time.

Preferably, the delivery device delivers a predetermined number of products from the storage container on actuation of a lever, button or on movement of the entire metering dispenser or only a part of the metering dispenser. In this context, exactly one product is preferably delivered. The number of products to be delivered during one delivery operation on the one hand can be predetermined during construction of the metering dispenser, and on the other hand an appropriate selection device which renders it possible for this number to be chosen individually by the user can be provided.

The delivery device of the metering dispenser according to the invention can be constructed, for example, in the form of valves actuated by gravity or delivery paths which result from the influence of gravity on movement of the metering dispenser. In this context, for example, a part of the delivery device, the entire delivery device or the entire metering dispenser can be tilted, rotated or the like in order to deliver a pre-portioned product by this movement.

Preferably, the pre-portioned products are delivered through a delivery opening, which can preferably be constructed such that in the first position or the closed position of the WC lid it is at the lowest point, and such that in the second position or the open position of the WC lid it is at the highest point of the metering dispenser.

In a first advantageous embodiment, the fixing region is constructed in order to fix the metering dispenser, preferably to fix it detachably, on a WC lid fixed movably on the WC bowl. This embodiment renders possible a convenient retrofitting of toilets with the metering dispenser according to the invention. Detachable fixing of the metering dispenser renders possible a simple refilling of the metering dispenser when the stock of pre-portioned products is consumed. This detachable fixing can be realized, for example, with the aid of adhesive strips which are reusable several times, with the aid of a fixing frame which is fixed to the WC lid and in its turn accommodates the metering dispenser by means of a lockable or catchable fixing or a fixing acting in a similar manner, or in diverse other ways.

It is furthermore advantageous for the delivery device to be constructed in order to deliver at least one pre-portioned product on movement of a WC lid, fixed movably on the WC bowl, relative to the WC bowl from a first position into a second position and/or from a second position into a first position. In this embodiment, either the metering dispenser can be fixed to the WC lid and the delivery device can be caused to deliver a pre-portioned product by the movement of the WC lid relative to the direction of gravity, or the metering dispenser can be fixed elsewhere in the region of the toilet and a button, lever or the like of the delivery device is actuated by the movement of the WC lid and a product is delivered.

In this context, it is advantageous in particular if the first position corresponds to a closed WC lid and the second position corresponds to an opened WC lid. Thus, for example, on opening, a portioned product having a fast activity, i.e. fast disinfecting action, cleaning action and/or development of fragrance, can be delivered. On closing, a product which develops the abovementioned actions in a slower and longer-lasting manner can preferably be delivered. In some embodiments, it is advantageous if a portioned product is delivered both on opening and on closing; this can be in each case the same or in each case a different product.

It is particularly preferable for the delivery device to be constructed such that in a first position at least one pre-portioned product enters into the delivery device from the storage container under the influence of gravity, and such that a predetermined number of pre-portioned products is delivered into the WC bowl under the influence of gravity on movement of the delivery device from the first position into a second position. In this embodiment, for example, a product can be delivered in each case on opening and/or closing of a WC lid. This is advantageous in particular if the metering device according to the invention is fixed to a WC lid.

It is advantageous if the delivery device comprises an intermediate storage region which is connected to the storage container and is constructed such that in a first position it is at least partly filled with pre-portioned products from the storage container under the influence of gravity, and such that the predetermined number of pre-portioned products is delivered into the WC bowl through a delivery region under the influence of gravity on movement of the delivery device from the first position into a second position. In this embodiment, a predetermined number of products can be kept in reserve in the intermediate storage region, and these product or some of these products are delivered on movement into the second position.

Alternatively to this, it is advantageous if the delivery device comprises: a first intermediate storage region which is connected to the storage container and is constructed such that in a first position it is at least partly filled with pre-portioned products, a second intermediate storage region which is connected to the first intermediate storage region and in which at least one pre-portioned product arrives on movement of the delivery device from the first into the second position, and a delivery region which is connected to the second intermediate storage region and through which the at least one pre-portioned product is delivered on movement of the delivery device from the second into the first position. In this embodiment, a predetermined number of products can be kept in reserve in the first intermediate storage region or the products can be fed to the first intermediate storage region and a predetermined number of products can then be kept in reserve in the second intermediate storage region. The products kept in reserve in the first or second intermediate storage region or some of these products can then be delivered on movement into the first position.

The metering dispenser according to the invention can in principle be constructed with a diverse number of intermediate storage regions. In this context, the intermediate storage regions can in each case be arranged relative to one another such that on each movement of the delivery region from the first into the second position or vice versa, a predetermined number of products from one intermediate storage region arrives in the next intermediate storage region.

The abovementioned embodiment can therefore be modified in that a number N of further intermediate storage regions is provided, which are each connected to one another such that on alternating movement of the delivery device between the first and the second position, the predetermined number of pre-portioned products in each case arrives in the next intermediate storage region, the last of the N intermediate storage regions being connected to the delivery region, through which the pre-portioned products are delivered on renewed alternating movement of the delivery device.

With this modification, for a certain arrangement of the delivery device a delivery takes place on movement from the second into the first position for an even number N, and with the same arrangement a delivery takes place on movement from the first into the second position for an odd number N.

The intermediate storage regions and the delivery region of the two abovementioned embodiments are preferably configured as adjacent channels, which can run parallel and are preferably separated from one another by in each case a common dividing wall.

The advantage of these two embodiments is, inter alia, that the delivery device itself manages entirely or partly without moving parts for individual delivery of counted portioned products. The delivery device of this embodiment can optionally itself be fixed movably on the metering dispenser in order to be able to assume the positions described relative to the direction of gravity. However, this embodiment is also advantageous in particular if the delivery device is fixed immovably on the metering dispenser and the corresponding positions relative to the direction of gravity are achieved by moving, in particular rotating, tilting or the like, the entire metering dispenser, which can be achieved, for example, in a particularly simple manner if the metering dispenser is fixed to a moving component, such as, for example, the WC lid.

The delivery device can furthermore comprise guide tracks for the product to be delivered, which are arranged such that mutual obstruction of the products takes place, and by this obstruction only in each case the delivery of a predetermined number of products takes place on movement from the first into the second position.

A further development of the metering dispenser according to the invention comprises a portioning device for delivery of a predetermined number of the pre-portioned product. This portioning device can advantageously be arranged in the transition to the delivery region or between the intermediate storage regions. It can be formed by moving, preferably gravity-actuated valves, barriers, catches or the like, or can be constructed in the form of an opening for passage arranged accordingly with respect to gravity and the delivery region or, respectively, the intermediate storage regions.

In this context, the portioning device can preferably be arranged between the intermediate storage region and the delivery region or between the first and the second intermediate storage region and can be constructed such that in the first position a predetermined number of pre-portioned products from the intermediate storage region or, respectively, the first intermediate storage region enters into the portioning device under the influence of gravity.

It is furthermore advantageous in this context if the portioning device comprises a passage region with a first section through which a portioned product can pass, and with a second section through which a portioned products can only partly pass, the first and second section being constructed such that a product which has arrived in the delivery region or, respectively, the second intermediate storage region through the first section prevents a product which has partly passed through the second section from arriving in the delivery region or, respectively, the second intermediate storage region. The passage region can be constructed, for example, in the form of an elongated opening, the width of which widens in the direction of movement of the products such that a product in the starting region of the opening (the second section) cannot pass through completely, and can pass through completely in the end region of the opening (the first section). Another variant of the passage region comprises two openings arranged one after the other in the direction of movement of the products, the first opening being too small for complete passage of the products and the second opening allowing complete passage. Thus, by means of the first product, the products advancing after the first product are prevented from being delivered simultaneously with this on movement into the second position.

In particular, the first and second section can be constructed such that a product which has partly passed through the second section prevents a product which has arrived in the delivery region or, respectively, the second intermediate storage region through the first section from being delivered into the WC bowl. Thus, the advancing products can prevent the first product from already being delivered in the first position.

In the two abovementioned embodiments, the second section of the passage region can preferably be an opening section which decreases in size continuously from the first section, or an opening section with a decreased jump in cross-section compared with the first section. A geometrically simple arrangement of opening sections which allow partial or complete passage of the products is achieved in this manner.

It is furthermore advantageous if the intermediate storage region or the first intermediate storage region is constructed, at least in the region of the first and second section of the portioning device, as an intermediate storage channel or first intermediate storage channel and preferably at least partly has a height there which is lower than the product height.

By this choice of the height of the channels, automatic obstruction is achieved particularly reliably and with a simple construction. When choosing the dimensions of the channels, it is to be ensured that these have dimensions in all regions such that a pre-portioned product running individually through the channels can pass these without obstruction. In this context, the reduction in height of the channel which has taken place between the two channels in the passage region, in particular of the second section of the passage region, can take place, since in this region the products partly project into the other channel.

In a further advantageous development, the delivery device comprises an intermediate storage section which is connected to the intermediate storage region or the first intermediate storage region and in which a predetermined, preferably adjustable number of pre-portioned products can be intermediately stored. In this embodiment, a delivery of a predetermined number of products is achieved in a simple manner. This number of products can be composed, for example, of the number of products in the intermediate storage section and products which have already entered into the delivery region or, respectively, the second intermediate storage region.

In this context, the portioning device can comprise an adjusting device for manual adjustment of the number of pre-portioned products to be delivered. This adjusting device can be, for example, in the form of a longitudinal or rotary slide valve.

In particular, in the two abovementioned embodiments it may be advantageous if the intermediate storage section is constructed as an extension of the intermediate storage region or the first intermediate storage region, the first end of which renders possible entry of pre-portioned products from the intermediate storage region or, respectively, the first intermediate storage region into the intermediate storage section, and the second end of which is closed by a moving shut-off device. The intermediate storage section formed in this way in the form of a dead-end can temporarily accommodate the products to be delivered in the first position, and the products accommodated there are subsequently passed on into the delivery region or, respectively, the second intermediate storage region on movement into the second position.

In this context it is particularly advantageous if the moving shut-off device can be displaced into several locked-in positions spaced apart from one another, the distance of which from one another approximately corresponds to the product dimension in the longitudinal direction of the intermediate storage section. Thus, a certain, adjustable number of products can be delivered, which is preferably detectable from the outside by means of markings.

As a development of the invention, it is advantageous to provide a component fixed detachably on the delivery device, preferably a delivery region constructed as a product guide channel, which is constructed such that when the component is fixed on the delivery device, a pre-portioned product is delivered on movement of the delivery device from a first into a second position, and when the component is not fixed on the delivery device, a pre-portioned product is delivered on movement of the delivery device from the second into a third position, which is preferably identical to the first position. By this component, the metering dispenser according to the invention can be adapted to suit the desired intended use. Thus, the component can be added or removed in order to change accordingly from a delivery of the product on opening to a delivery of the product on closing of the WC lid or vice versa.

Alternatively or additionally, it is advantageous if a switching device which cooperates with the delivery device and has a first switch position in which a pre-portioned product is delivered on movement of the delivery device from a first into a second position, and a second switch position in which a pre-portioned product is delivered on movement of the delivery device from the second into a third position, which is preferably identical to the first position, is present. This embodiment renders possible switching between delivery during opening or during closing which is simpler for the user. The switching device can comprise, for example, a barrier for a delivery channel or for a delivery opening.

In this context, the switching device can comprise a shut-off device which renders possible, in the first position, a delivery of the pre-portioned products from a second intermediate storage region, as described above, and does not render this delivery possible in the second position. The shut-off device can function as a guide or locking device, and can be arranged in the region of the second intermediate storage region or of the delivery region.

A further advantageous embodiment is distinguished in that the delivery device comprises a manual triggering device and is constructed in order to deliver at least one portioned produce when the triggering device is actuated. This triggering device can include, as described above, levers, buttons, slides or the like which release a delivery path or an opening of the delivery device.

It is advantageous for an embodiment of simple construction in particular if the delivery device is fixed immovably on the metering dispenser.

In a further advantageous embodiment of the metering dispenser according to the invention, at least one section of the wall demarcating the storage container is transparent for the purpose of checking the level of fill. The transparent section can be constructed, for example, as an elongated viewing window. The metering dispenser according to this embodiment can furthermore be produced entirely from a transparent material, for example a transparent plastic, so that checking the level of fill is particularly easy, and moreover an aesthetic effect is achieved.

It is furthermore advantageous if the storage container is constructed in order to accommodate refill magazines with pre-portioned products. Particularly simple refillability of the metering dispenser is achieved in this manner.

Finally, in a further advantageous development the pre-portioned products are spherical. Spherical products have the advantage that because of their good rolling properties they can be delivered and portioned particularly easily in all directions and do not tend to form unintended mutual blocks or accumulations.

The pre-portioned products preferably have dimensions which render it possible to achieve the desired cleaning, disinfecting and/or fragrance action by releasing a portion of in each case one pre-portioned product. For this, dimensions of from 4 to 25 mm have proved suitable for conventional active compound compositions, in particular the formulation examples given below. Dimensions of the pre-portioned products which are between 5 and 15 mm are suitable in particular. These dimension ranges on the one hand define a product which is easy to handle and can be stored in a metering dispenser of small dimensions, in particular low construction height, and on the other hand the amount of product is sufficient for the desired action. These dimensions generally define a cube-shaped shell body which has the appropriate edge length and encloses the pre-portioned products. In the case of a cube-shaped, pre-portioned product, these dimensions can be the edge length of the product itself. In the case of the preferred spherical product, these dimensions represent the diameter of the product.

A further advantageous embodiment of the metering dispenser according to the invention is distinguished by a second delivery device, by means of which a portioned product can be delivered into the WC bowl. In this embodiment, the products can be delivered on opening and on closing.

This development can be improved further by a second storage container which cooperates with the second delivery device. This embodiment is advantageous in particular if a first portioned product, e.g. a product which displays its action rapidly, is to be delivered on movement from a first into a second position, and a second, differently portioned product, for example a product which displays its action slowly, is to be delivered on movement from the second into the first position. In this embodiment, the two storage containers can be filled with the same or different products and the two portioned products can then be delivered at the same time or at different times.

This embodiment can be developed still further in that the second delivery device is developed as described above in respect of the embodiments with one storage container, a delivery of a pre-portioned product from the first storage container taking place on movement of the first delivery device from a first into a second position and a delivery of a pre-portioned product from the second storage container taking place on movement of the second delivery device from the second into the first position. A particularly simple construction form of the double metering dispenser is achieved with this embodiment.

A further aspect of the invention is a refill magazine for a metering dispenser of the type described above.

A further aspect of the invention is a lid for a toilet with a metering dispenser fixed thereto having a storage container for accommodating the product, which is constructed for accommodation of pre-portioned products, and a delivery device which is constructed in order to deliver at least one pre-portioned product from the storage container into the WC bowl. In such a lid, the metering dispenser described above can be integrated in a particularly elegant manner and a total picture which is overall more pleasing can be achieved than in the case of subsequent fixing of a metering dispenser to a commercially available WC lid. Furthermore, the space available can be utilized better in the case of the lid with an at least partly integrated metering dispenser.

A further aspect of the invention is a toilet with a metering dispenser fixed thereto having a storage container for accommodating the product, which is constructed for accommodation of pre-portioned products, and having a delivery device which is constructed in order to deliver at least one pre-portioned product from the storage container into the WC bowl. This aspect of the invention also is represented in particular by the relatively wide freedom of design in the construction of the integrated metering dispenser. From the marketing aspects of the product, it is moreover often advantageous to offer a toilet which is already equipped with the advantages achieved according to the invention or a correspondingly equipped WC lid in order to spare the user assembly steps and the risk of incorrect assembly when retrofitting a metering dispenser.

In this context, the WC lid described above or the toilet described above can be developed in particular according to one of the advantageous embodiments described above for the metering dispenser.

Finally, a further aspect of the invention is a method according to claim 35. The use of this method is of interest in particular in the public sector or in the field of toilets used commercially, in order to achieve reliable hygiene in the toilet region giving rise to low personnel costs.

Advantageous embodiments of the method according to the invention are described in claims 36 and 37. Reference is made to the correspondingly developed devices regarding the embodiments and advantages of these methods.

Figure 2A:
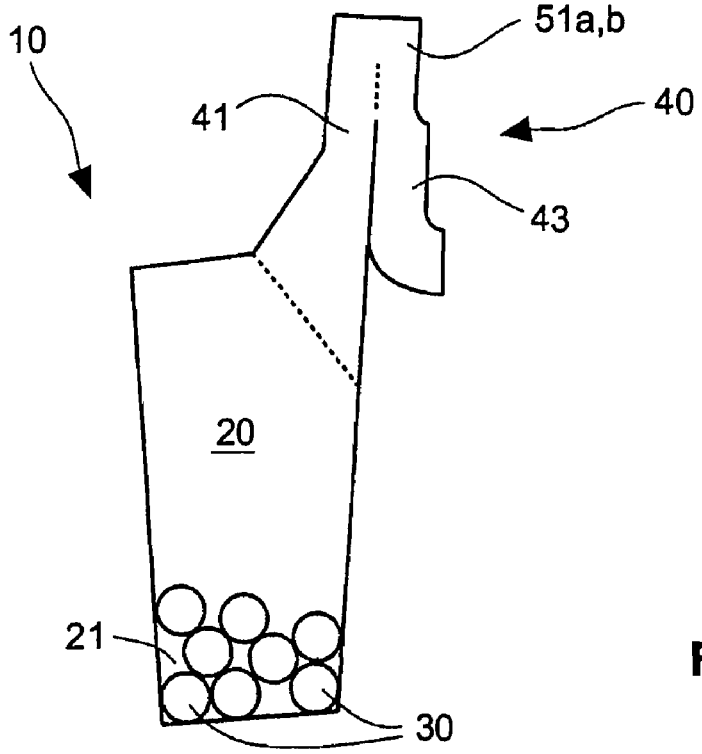
Figure 2B:
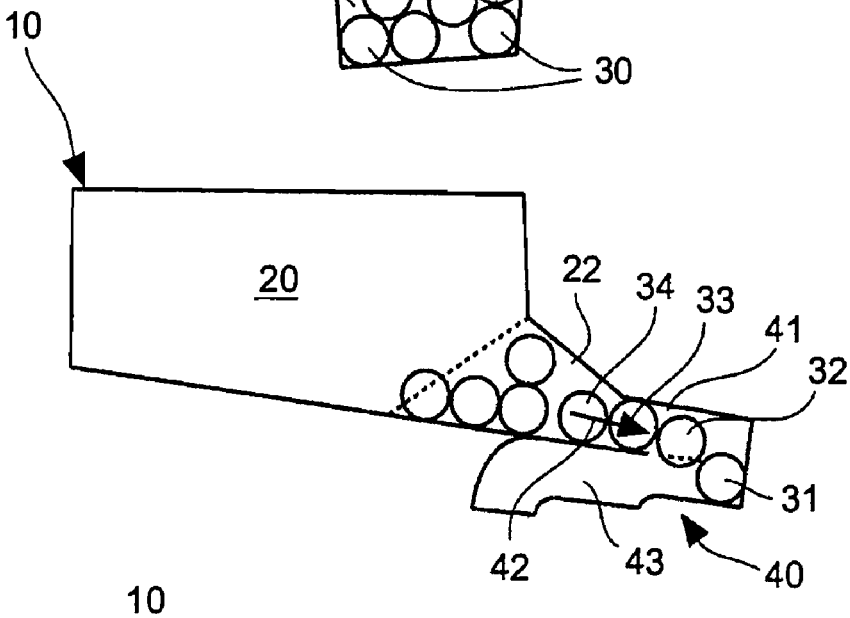
Figure 2C:
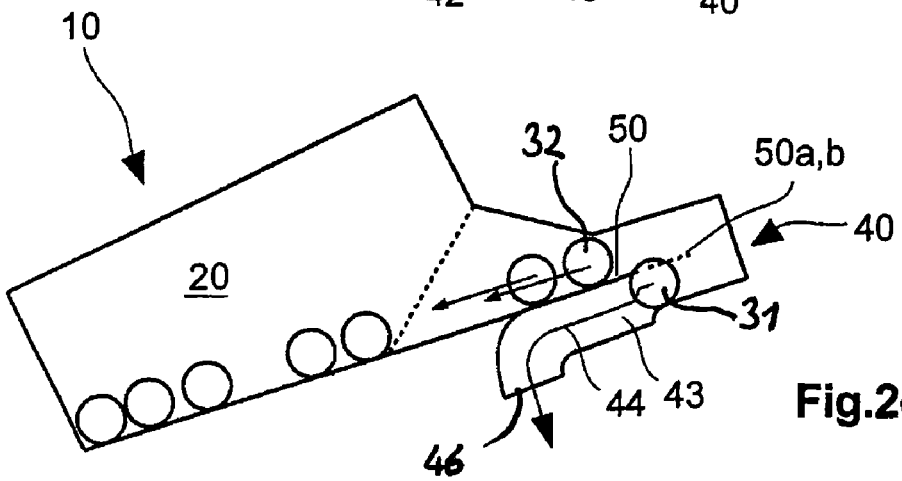
Figure 3A:
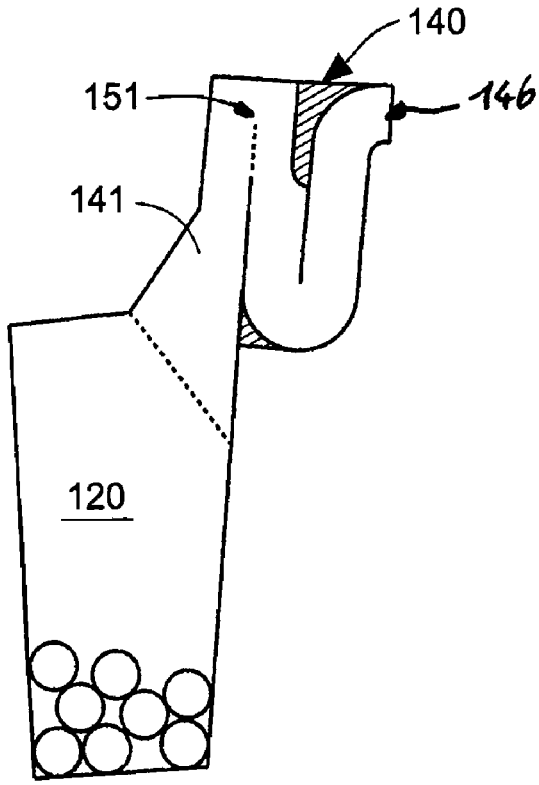
Figure 3B:
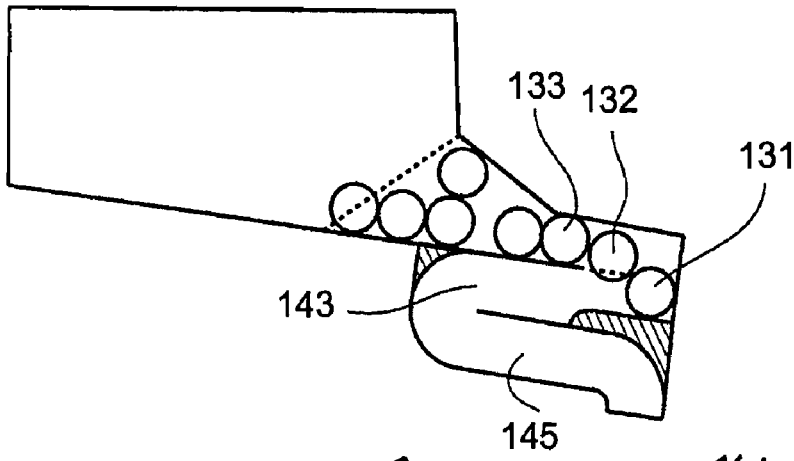
Figure 3C:
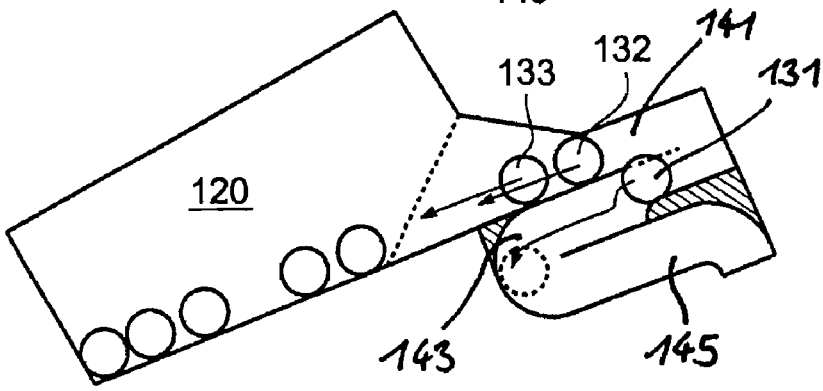
Figure 3D:
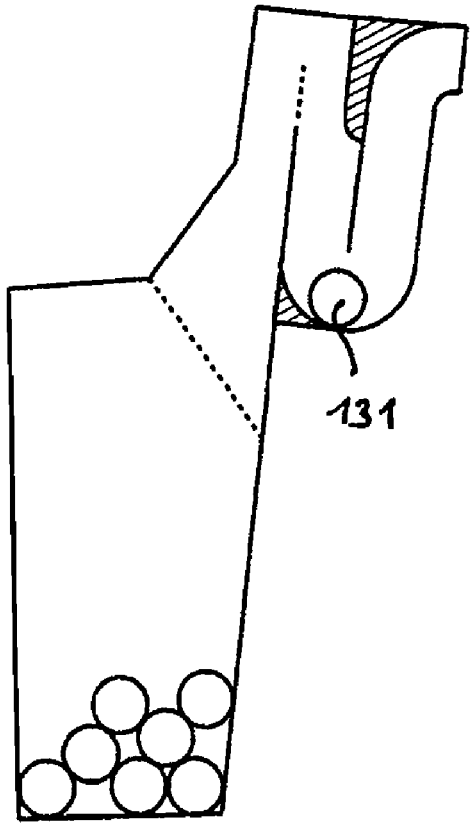
Figure 3E:
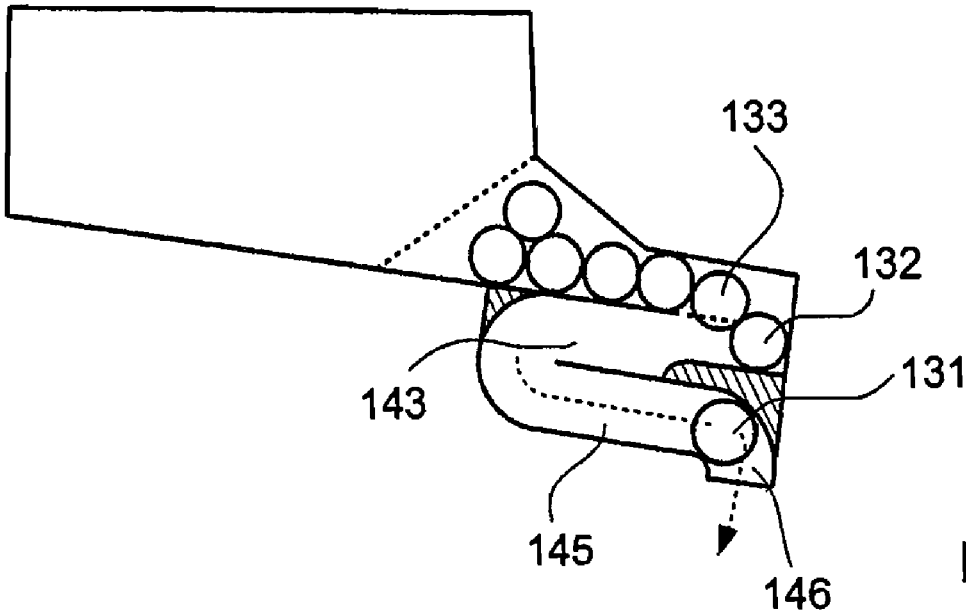
Figure 4A:
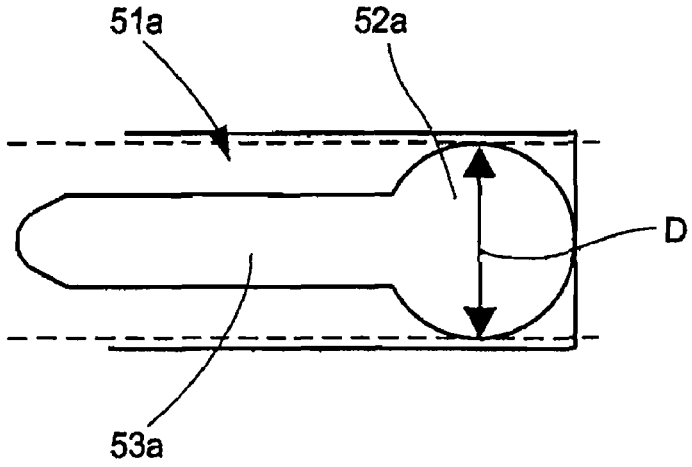
Figure 4B:
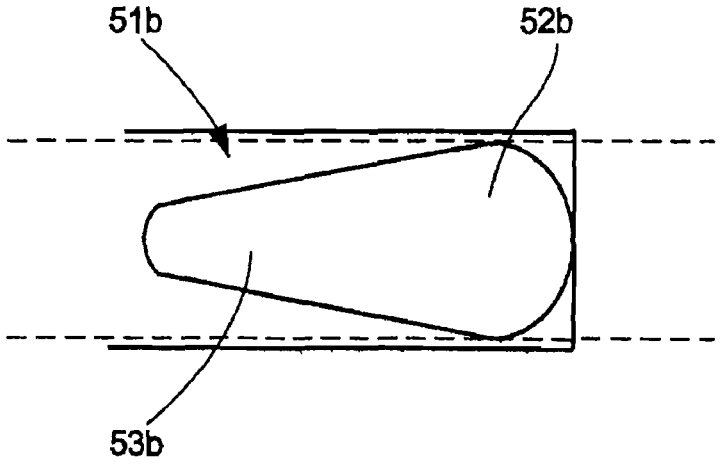
Figure 4C:
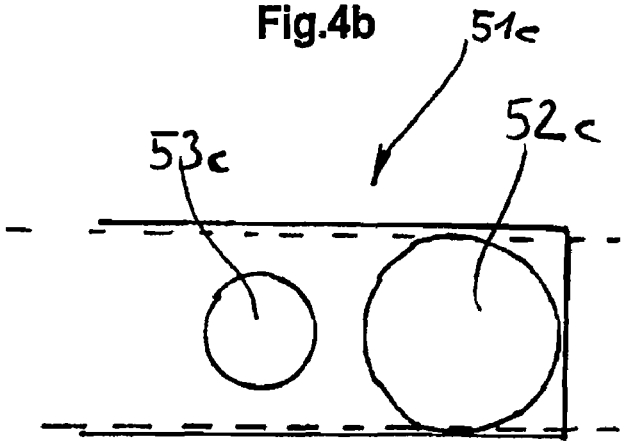
Figure 5A:
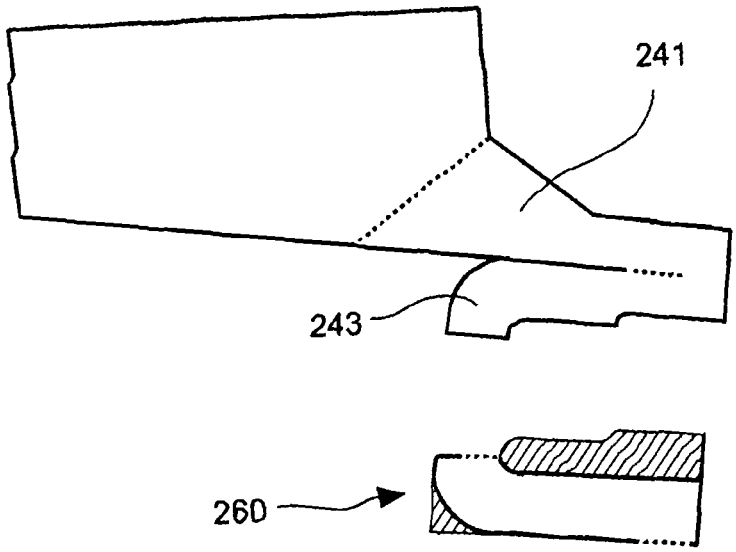
Figure 5B:
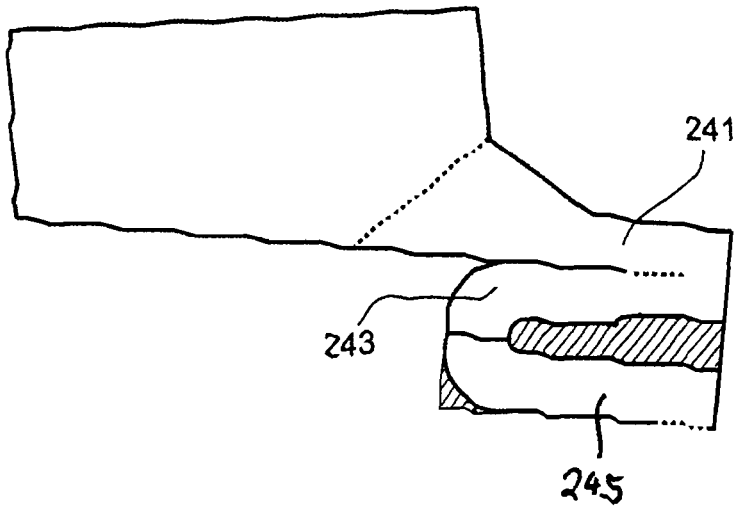
Figure 6:
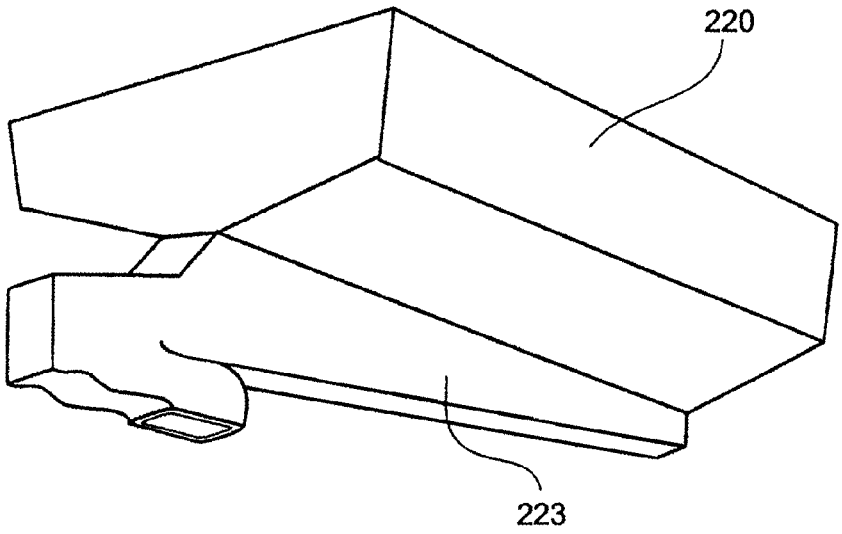
Figure 7:
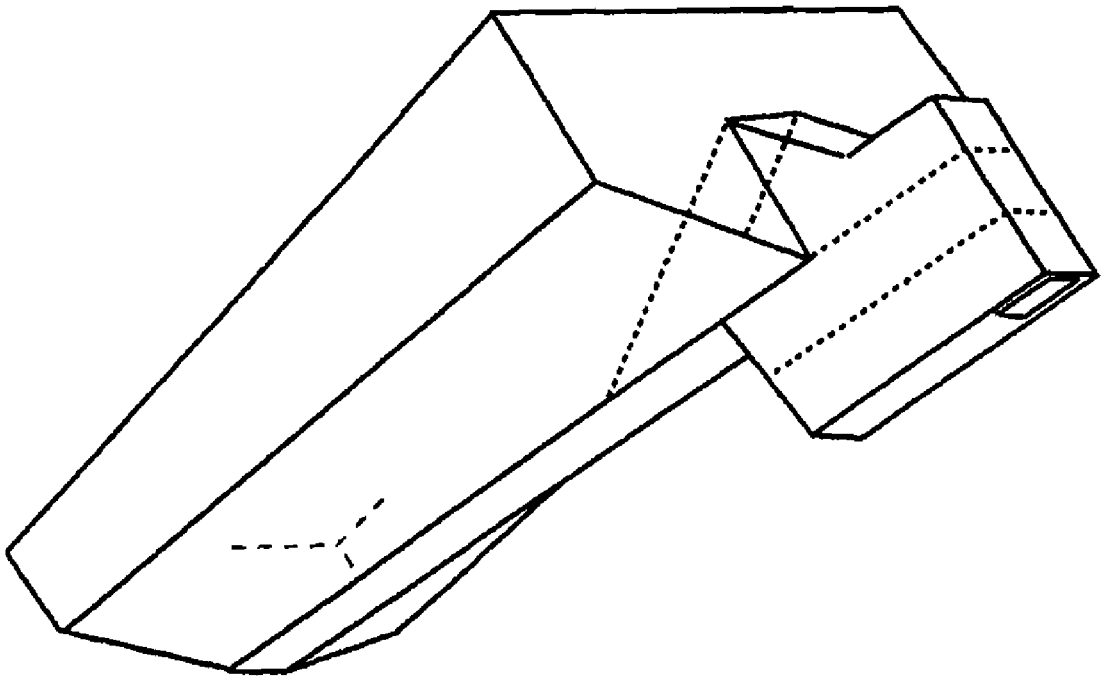
Figure 8:
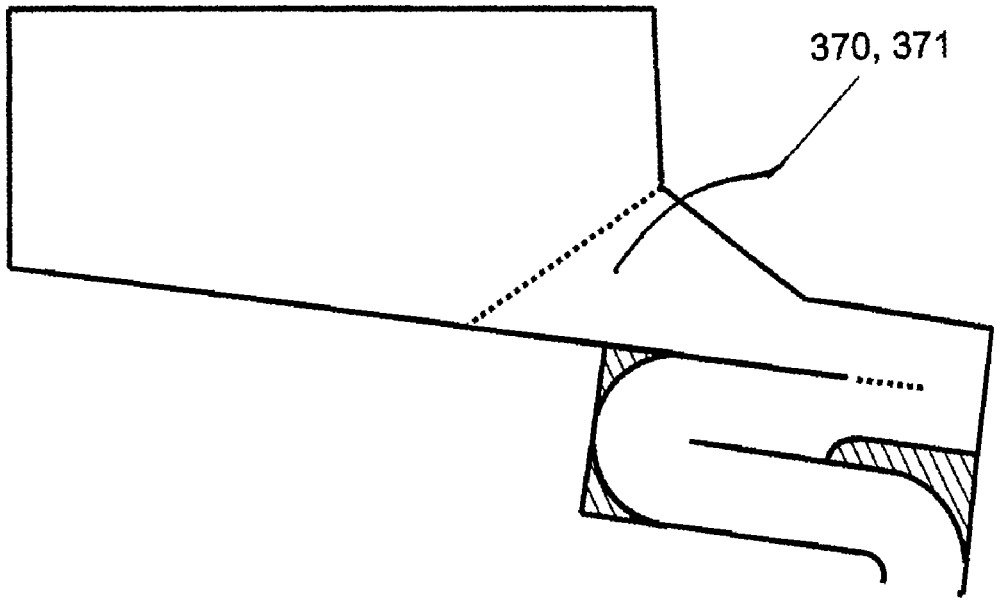
Figure 9:
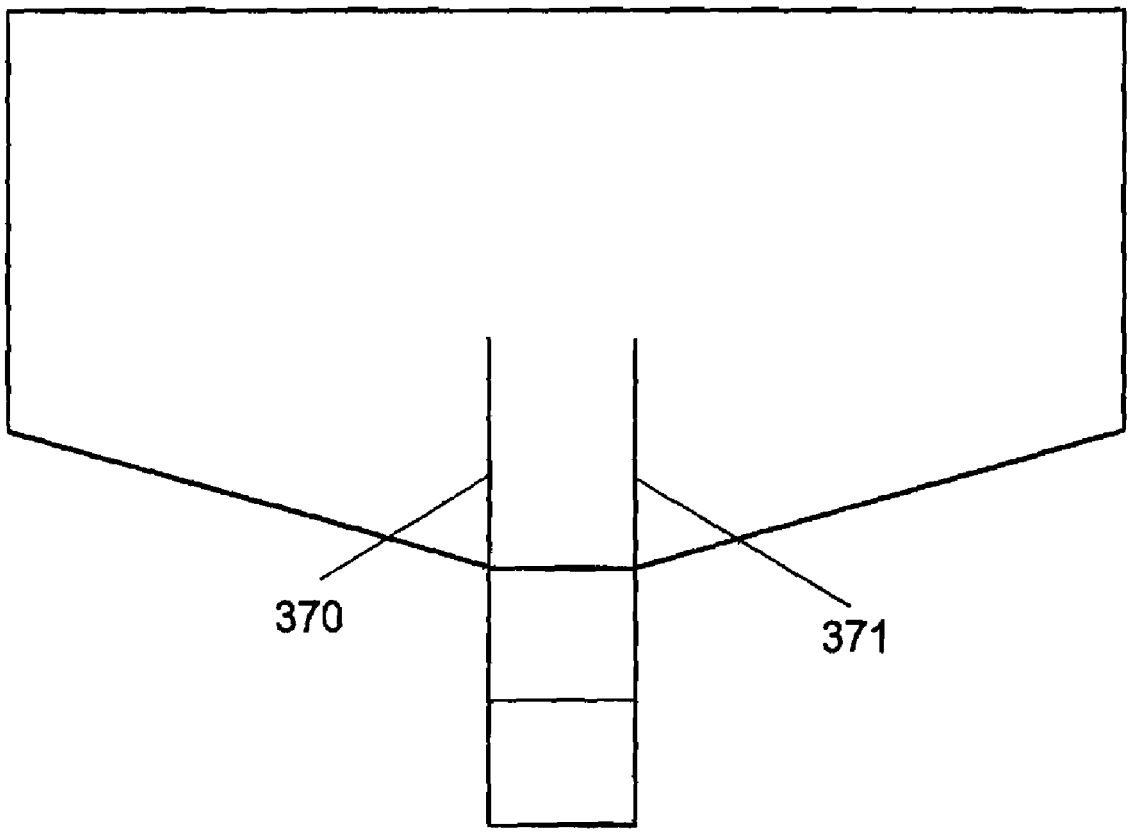
Figure 10A:
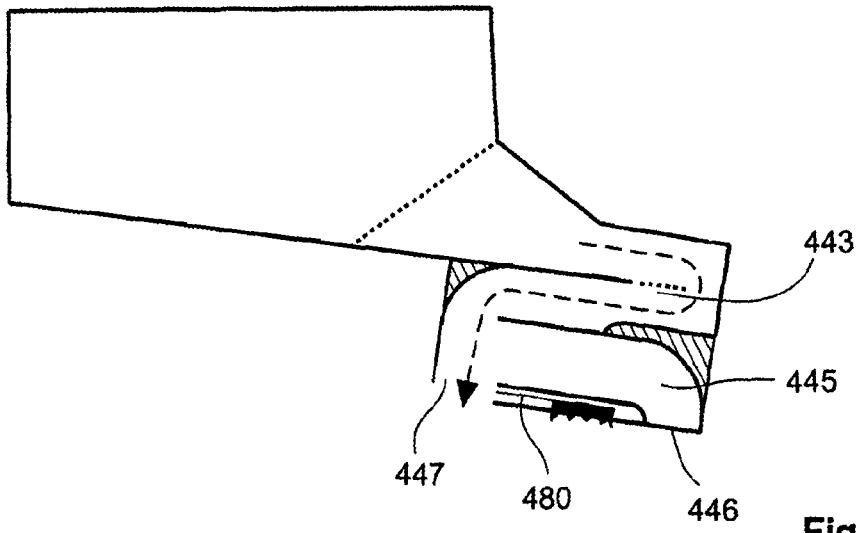
Figure 11A:
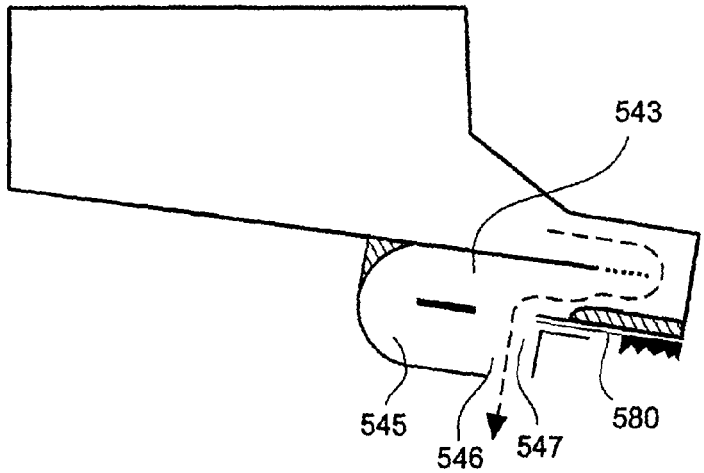
Figure 12A:
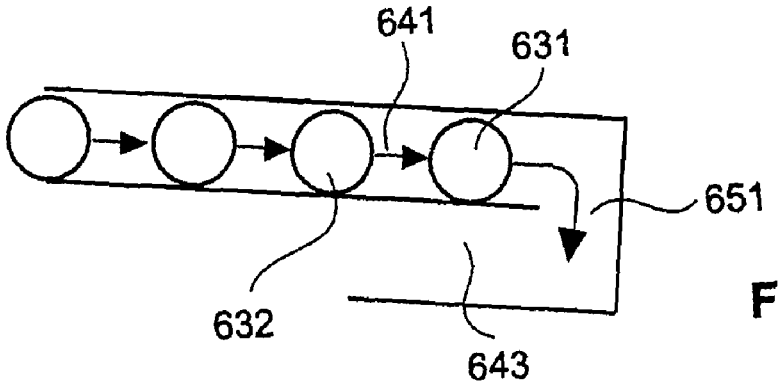
Figure 12B:
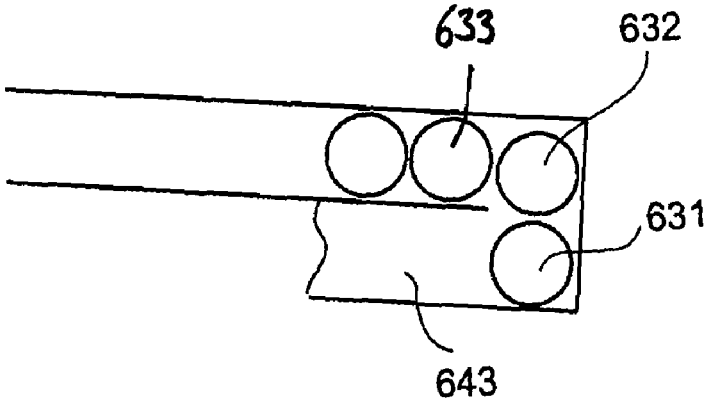
Figure 12C:
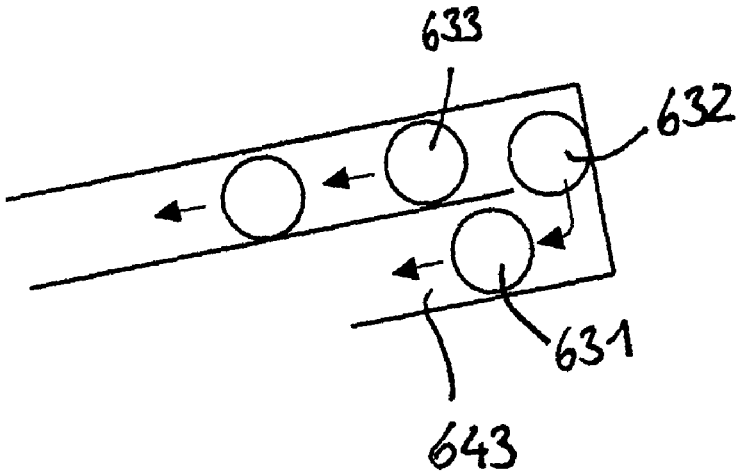
Figure 13A:
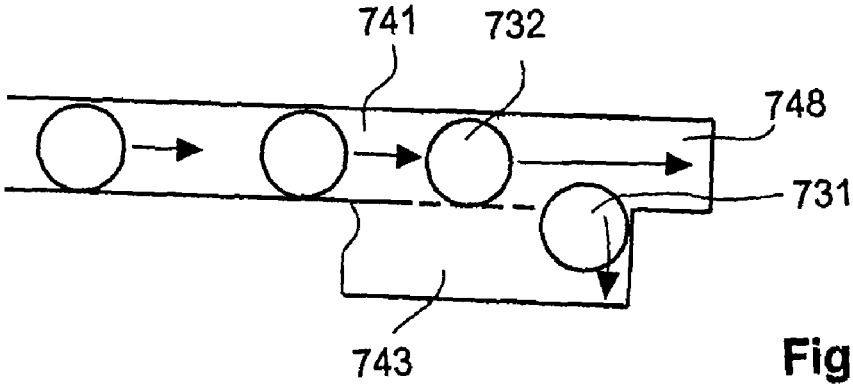
Figure 13B:
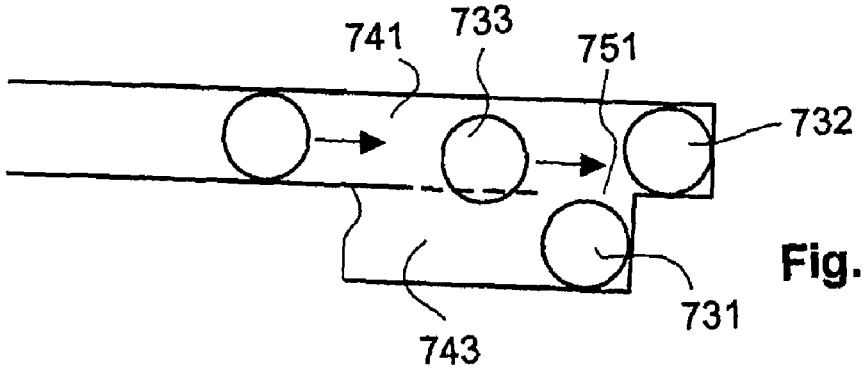
Figure 13C:
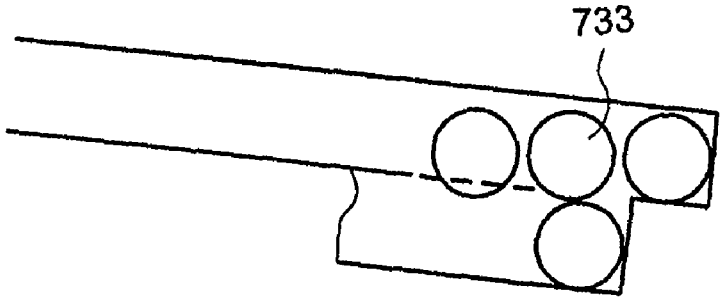
Figure 13D:
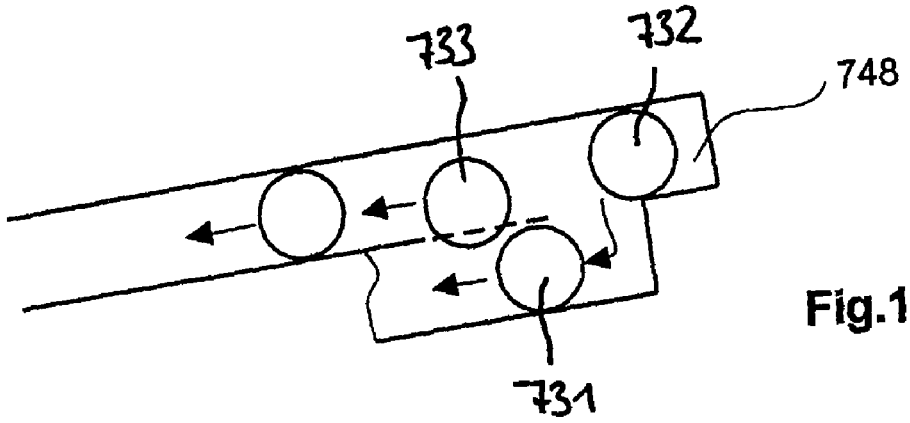
Figure 14A:
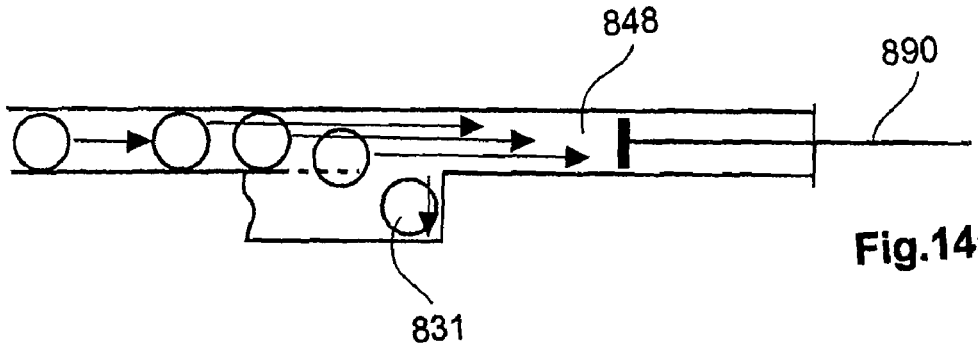
Figure 14B:
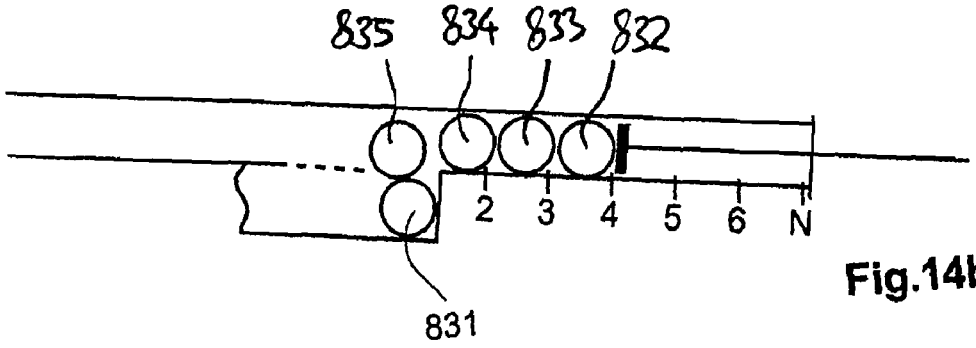
Figure 14C:
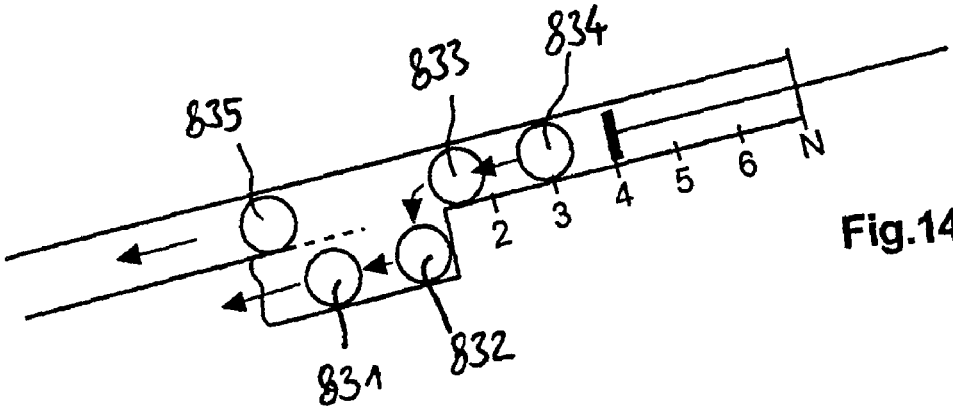
Figure 15:
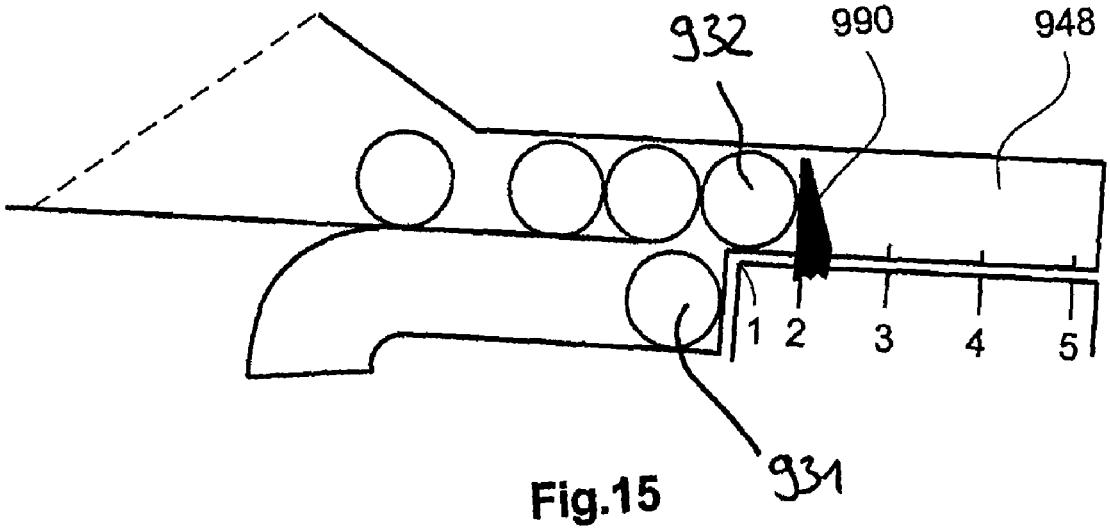
Figure 16:
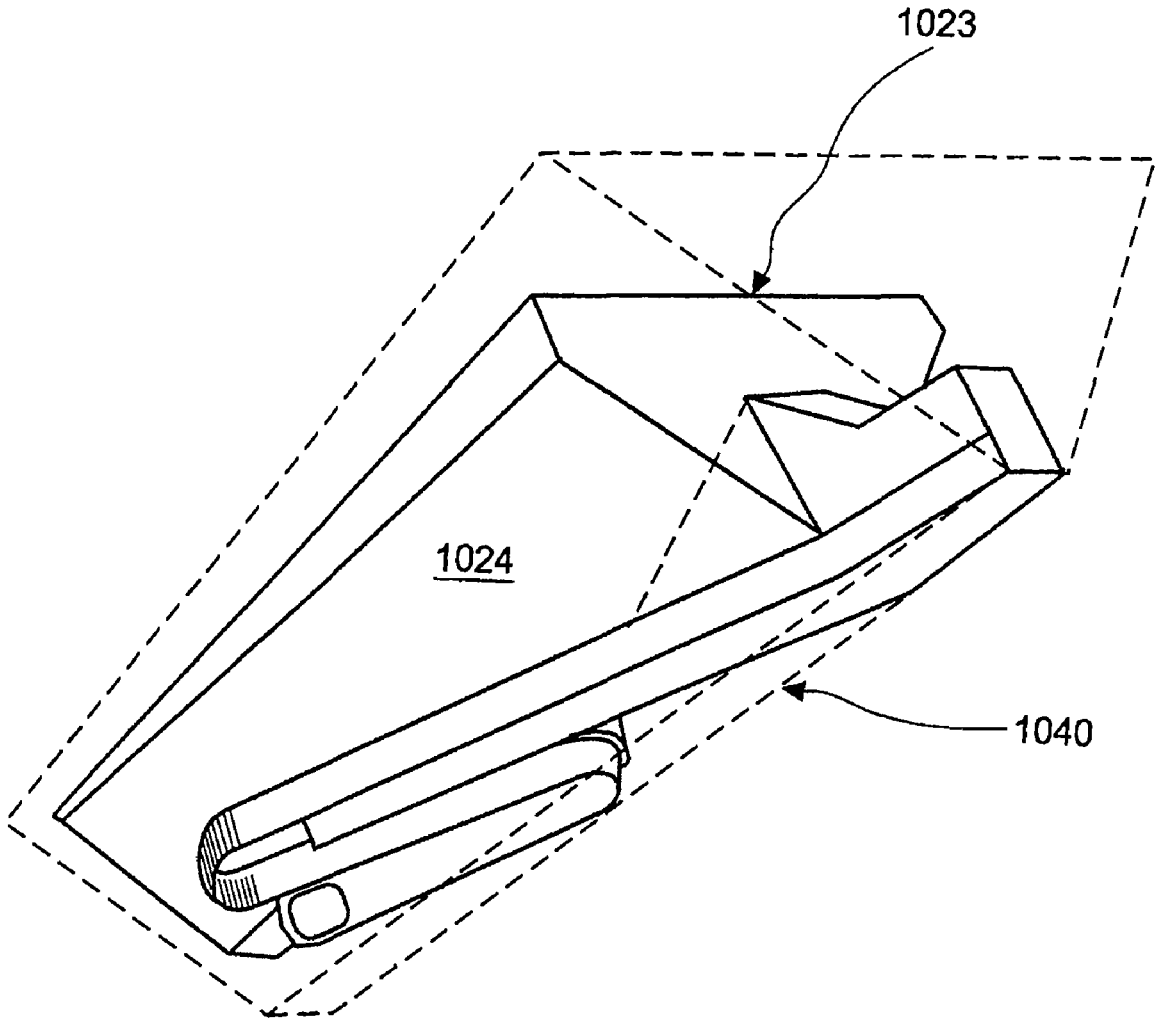
Figure 17A:
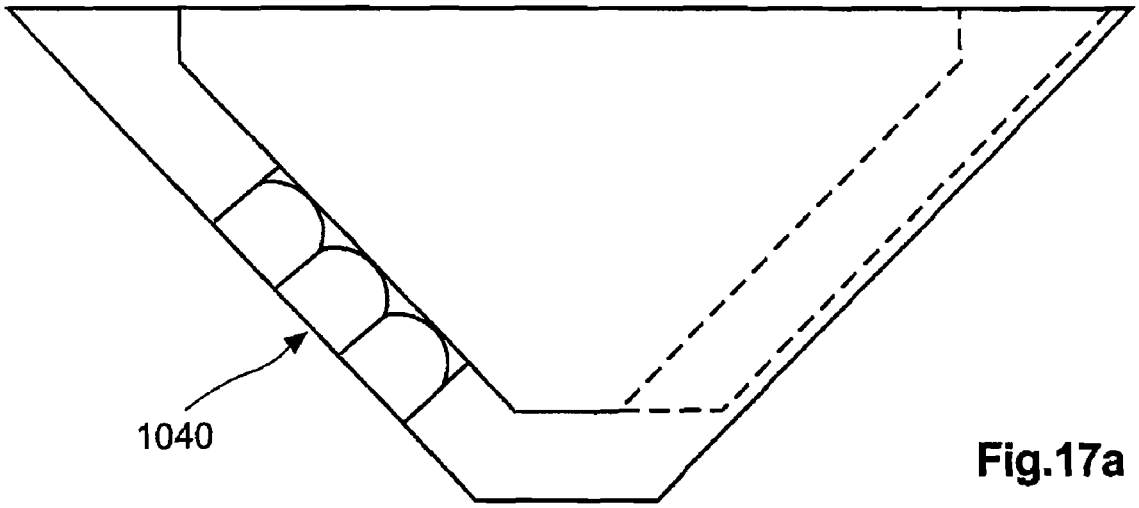
Figure 18:
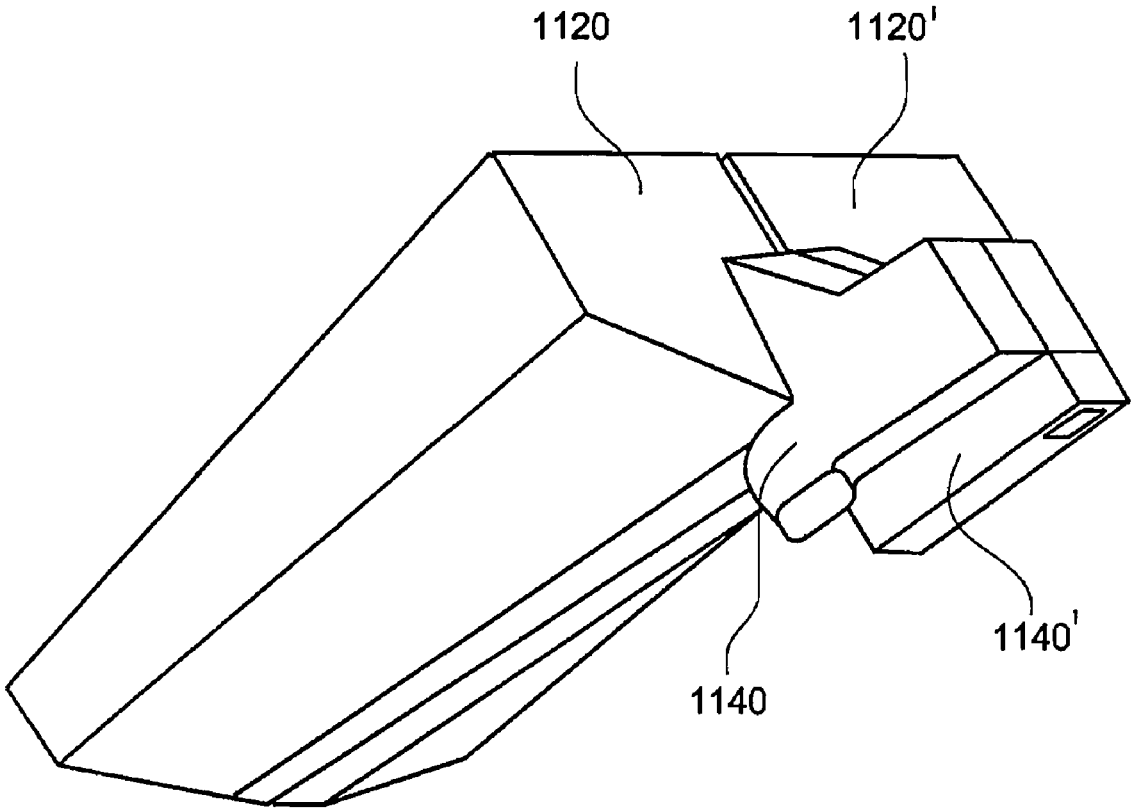
Figure 19:
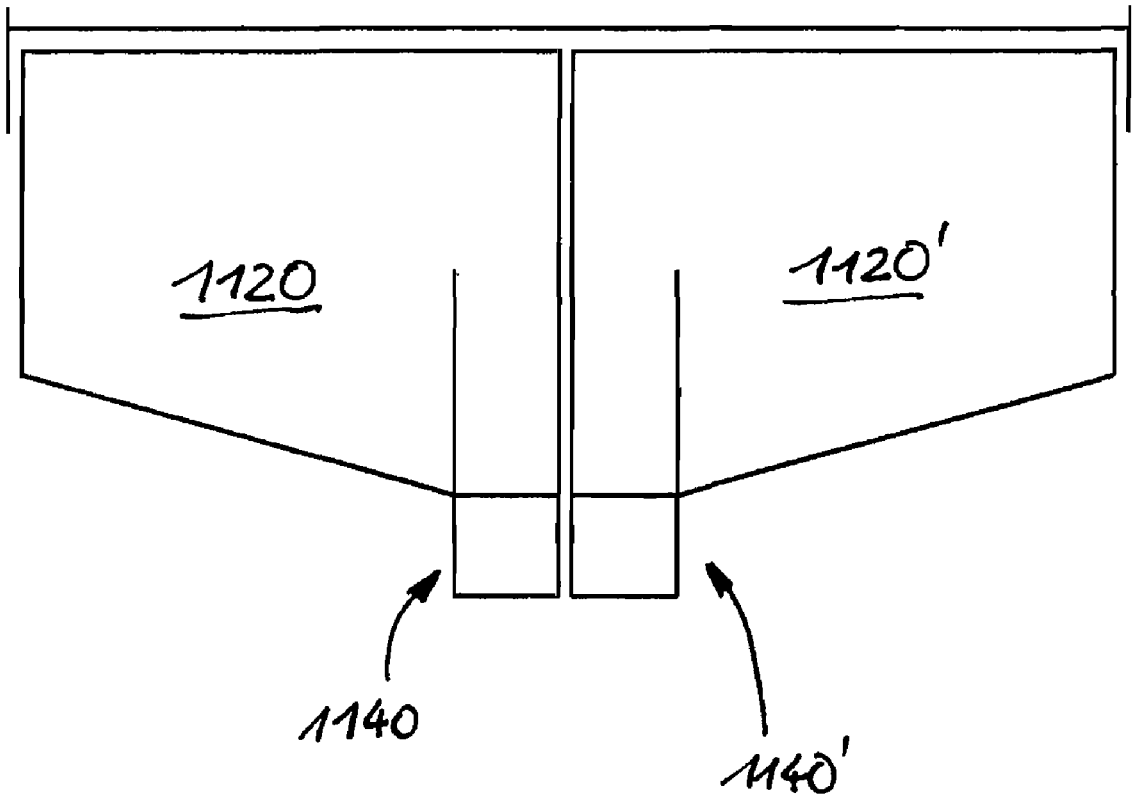

Some advantageous embodiments of the invention are described with the aid of the appended figures. In these:

FIG. 1 shows a diagram of a perspective view of general arrangement of the embodiment of the metering dispenser according to the invention on a WC lid, FIG. 2*a-c* shows a diagram, in section, of a side view of the arrangement of portioned products within a first embodiment of the metering dispenser according to the invention in the course of a delivery operation on movement from a first into a second position, FIG. 3*a-e* shows a diagram, in section, of a side view of the arrangement of portioned products within a second embodiment of the metering dispenser according to the invention for delivery of products on movement from a second into a first position, FIG. 4*a-c* shows a plan view of three embodiments of the passage region between the delivery channels of the delivery device of the metering dispenser according to the invention, FIG. 5*a, b* shows a diagram of a third embodiment of the metering dispenser according to the invention with a mountable product guide channel for changing the delivery condition, FIG. 6 shows a perspective view of the metering dispenser according to the invention according to FIG. 5*a* from an angle from underneath without the product guide channel attached, FIG. 7 shows a perspective view of a fourth embodiment of the metering dispenser according to the invention with a flat container base and ball guide plates inside the container, FIG. 8 shows a diagram, in section, of a side view of the embodiment according to FIG. 7, FIG. 9 shows a diagram, in section, of a front view of the embodiment according to FIG. 7, FIG. 10*a, b* shows a diagram, in section, of a side view of a fifth embodiment of the metering dispenser according to the invention with a switching device for changing the delivery condition, FIG. 11*a, b* shows a diagram, in section, of a side view of a sixth embodiment of the metering dispenser according to the invention with a switching device for changing the delivery condition, FIG. 12*a-c* shows a diagram of the functional progress of the form of the delivery device for delivery of two pre-portioned products, FIG. 13*a-d* shows a diagram of the functional progress of a second variant of a delivery device for delivery of two pre-portioned products, FIG. 14*a-c* shows a diagram of the functional progress of a third variant of the delivery device for delivery of several pre-portioned products, FIG. 15 shows a variant of the embodiment according to FIG. 14, FIG. 16 shows a perspective view of a seventh embodiment of the metering dispenser according to the invention from an angle from underneath, with raised ball tracks on a side face of the storage container, FIG. 17*a, b* shows, in section, a front view of the embodiment according to FIG. 16 with the sectional plane illustrated, FIG. 18 shows a perspective view from an angle from underneath of an eighth embodiment of the metering dispenser according to the invention for delivery of various pre-portioned products under various delivery conditions, FIG. 19 shows, in section, a front view of the embodiment according to FIG. 18, The metering dispenser 10 shown in FIG. 1 is fixed to the under-side of a WC lid 101 of a toilet 100, such that when the WC lid is closed the metering dispenser is not visible from the outside and projects into the WC bowl 102.

FIG. 2*a* shows a cross-sectional side view of the metering dispenser 10. The metering dispenser is constructed trapezoidal in cross-section, and in a second position according to FIG. 2*a*, which corresponds to the position with the WC lid 101 opened when the metering dispenser 10 is fixed according to FIG. 1, the portioned products, which in this embodiment are balls 30, are (always) in a closed region 21 of the storage container 20 under the influence of gravity.

In the first position, shown in FIG. 2*b*, which corresponds to the position with the WC lid 101 closed when the metering dispenser is fixed according to FIG. 1, due to the trapezoidal form of the storage container 20, under the influence of gravity the balls 30 are in a region 22 of the storage container 20 connected to a delivery device 40, and in the delivery device 40.

The delivery device 40 shown comprises an intermediate storage channel 41, which defines a rolling path for the balls 31-34 in a first direction which is identified with an arrow 42 in FIG. 2*b*.

When the delivery device 40 is in the first position, shown in FIG. 2*b*, i.e. the position with the WC lid 101 closed when the metering dispenser is fixed according to FIG. 1, the balls 31-34 from the storage container enter into the intermediate storage channel 41.

Parallel and adjacent to the intermediate storage channel 41 there is arranged a delivery channel 43, which defines a second rolling direction which is identified with arrow 44.

The intermediate storage channel 41 and the delivery channel 43 are separated from one another by a dividing wall 50, in which there is a connecting region 51*a-c*.

The connecting region 51*a-b* has in a first embodiment 51*a* shown in FIG. 4*a* a first section 52*a*, through which the balls from the intermediate storage channel 41 can pass over into the delivery channel 43. For this purpose, the first section is substantially circular in construction and has a diameter D which is greater than the diameter of the balls 31-34

A second section 53*a*, the width of which is constant and has dimensions so low that the balls 31-34 can project only with a part of their volume from the intermediate storage channel 41 through the second section 53*a* into the delivery channel 43, follows on from the first section 52*a*.

In a second embodiment 51*b* shown in FIG. 4*b*, the opening 51*b* has a first section 52*b* through which the balls 31-34 can pass completely, and which is followed by a second section 53*b*, the width of which decreases continuously from the width required for passage of balls. The opening 51*b* is consequently constructed in the form of an elongated hole which increases continuously in width in the direction 42. The balls rolling in in the region of the opening 51*b* in direction 42 can therefore, in the second section 53*b*, initially project only with a part of their volume from the intermediate storage channel 41 into the delivery channel 43. The further the balls move in the direction of the first section 52*b*, the greater the volume of the balls 31-34 projecting into the delivery channel 43 becomes, and when the balls arrive in the first section 52*b*, they can fall completely into the delivery channel 43.

In a third embodiment according to FIG. 4*c*, the passage region 51*c* is constructed in the form of two holes 52*c*, 53*c* spaced apart, of which the first hole 53*c* has a diameter which is too small for complete passage of the balls, and the second hole 52*c* has a diameter which allows complete passage of the ball.

The delivery device according to FIG. 2*a-c* is constructed in order to deliver a ball when the delivery device is moved from the first position into the second position, that is to say, in the arrangement according to FIG. 1, when the WC lid is opened. The delivery operation is explained with the aid of FIGS. 2*a-c:*

When the delivery device is in the first position, the balls roll out of the storage container into the intermediate storage channel 41, and in this intermediate storage channel 41 up to the end in which there is the opening 51.

The ball 31 rolling first of all arrives in the first section 52*a, b* of the opening 51*a, b* and falls through this first section into the delivery channel 43. Due to the angled position of the delivery device, the first ball 31 cannot roll further into the delivery channel 43. Due to the reduced height of the delivery channel 43 in the region of the opening 51*a, b*, a part of the ball 31 projects into the intermediate storage channel 41 and thus prevents further rolling and passage of the following balls 32-34, so that a ball arrangement according to FIG. 2*b* results.

When the delivery device is moved into the second position according to FIG. 2*c*, the balls 32-34 roll in the direction opposite to arrow 44. The ball 31 cannot roll in the direction according to arrow 44 directly after movement of the delivery device from the first into the second position, since it is blocked by the volume of the ball 32 which has passed through the section 53*a, b* into the delivery channel 43.

Only when the ball 32 has rolled away from the second section 53*a, b* of the opening 51*a, b* can the ball 31 roll to the delivery channel 43 following in the direction of the arrow 44 and be delivered through an exit opening 46.

FIGS. 3*a-e* show a second embodiment of the metering dispenser according to the invention, which is constructed in order to deliver pre-portioned products on movement of the metering dispenser from a second into a first position, that is to say in the arrangement according to FIG. 1, on closing of the WC lid.

The embodiment described is shown in a second position in FIG. 3*a*, which corresponds to a position with the WC lid open. The situation shown in FIG. 3*a* corresponds to the situation after the first assembly or after refilling of the metering dispenser according to the invention. When the metering dispenser is moved from the second position, shown in FIG. 3*a*, into the first position, shown in FIG. 3*b*, which corresponds to the position with the WC lid closed, the balls 30 from a storage container 120 enter into a first intermediate storage channel 141 of a delivery device 140.

The ball 131 rolling first of all falls here through a gap 151, which can be constructed according to the opening 51*a, b*, into a second intermediate storage channel 143 and in this position blocks the following ball 132, the volume of which projects partly through the gap 151.

When the metering dispenser is moved from this first position back into the second position, as shown in FIG. 3*c, d*, the first ball 131 moves through a second intermediate storage channel 143 into the connecting region between the second intermediate storage channel 143 and a delivery channel 145. The other balls 132, 133 roll back into the storage container 120.

In the second position, shown in FIG. 3*d*, which corresponds to the normal position after the WC lid has been opened and closed several times, the ball 131 is in the region between the second intermediate storage channel 143 and the delivery channel 145.

When the metering dispenser is moved from this second position into the first position, according to FIG. 3*e*, that is to say the WC lid is closed, the ball 131 moves through the delivery channel 145 and is delivered through the exit opening 146.

FIGS. 5*a* and *b* show a third embodiment of the metering dispenser according to the invention, which can be modified in respect of the delivery condition by attaching a product guide channel.

In the configuration of this embodiment shown in FIG. 5*a*, the metering dispenser functions like that metering dispenser which has been described with reference to FIG. 2*a-c*, i.e. the metering dispenser has an intermediate storage channel 241 and a delivery channel 243. In this configuration, a product is delivered on movement of the metering dispenser from a first into a second position.

When the product guide channel 260, shown separately in FIG. 5*a*, is mounted on the metering dispenser according to FIG. 5*a*, the second configuration according to 5*b* results. In this second configuration, the metering dispenser corresponds to the embodiments described with reference to FIGS. 3*a-e*. The channel section previously functioning as an intermediate storage channel 241 takes over here the function of the first intermediate storage channel, the channel section previously functioning as the delivery channel 243 takes over the function of the second intermediate storage channel 243, and the attached product guide channel 260 forms the delivery channel 245. In this second configuration, a product is delivered when the metering dispenser is moved from the second into the first position.

FIG. 6 shows the embodiment according to FIG. 5*a*. In this diagram, it can be seen particularly clearly that a groove-shaped region 223 is constructed on the under-side of the storage container 220, which extends in the longitudinal direction of the storage container and has a width which is slightly larger than the product dimension in the transverse direction. The groove-shaped recess of the storage container in the lower region has proved to be particularly advantageous for ensuring a reliable feed of products into the delivery region without mutual blocking or obstruction of the balls in the storage container, in particular in the region of entry of the balls from the storage container into the delivery device. The groove-shaped recess 223 has proved appropriate generally in this context for all embodiments of the metering dispenser according to the invention, and is not limited to the embodiment according to FIG. 5*a, b*.

FIG. 7 shows a fourth embodiment of the metering dispenser according to the invention which is constructed as a closer, that is to say delivers products on movement from the second position (WC lid opened) into the first position (WC lid closed). In this embodiment, as a modification of the form according to FIG. 6, the construction of a groove-shaped structure in the lower part of the storage container is furthermore omitted.

In the fourth embodiment shown in FIGS. 7-9, ball guide plates 370, 371 are arranged inside the storage container, these being arranged in the region of entry of the balls from the storage container into the delivery device. The ball guide plates 370, 371 extend over the entire connecting region between the storage container and delivery device and are aligned in the longitudinal direction to the direction of movement of the balls on entry into the delivery device. The ball guide plates 370, 371 enclose the entry into the delivery device on both sides and are spaced apart from one another somewhat further than the width of the products in the transverse direction. Preferably, the distance between the ball guide plates 370, 371 corresponds to the width of the groove according to the embodiment of FIG. 6.

FIGS. 10*a, b* show a fifth embodiment of the device according to the invention, in which a switching device is present in order to change the metering dispenser from delivery of a product on movement from the first into the second position to delivery of a product on movement from the second into the first position.

Figure 10B:
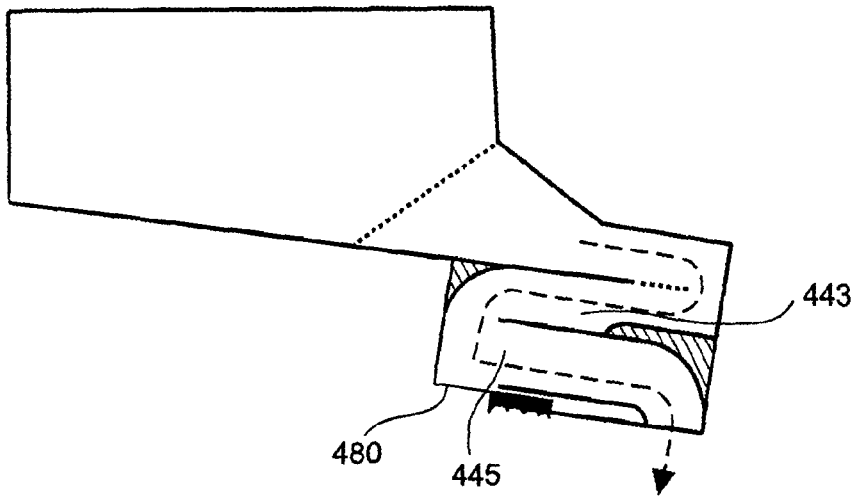

The embodiment according to FIG. 10*b* corresponds to the embodiment according to FIGS. 3*a-e* in respect of the path of the products. However, the embodiment according FIG. 10*a, b* deviates from the embodiment according to FIG. 3*a-e* in that the delivery channel 445 is closed by a slide 480 in the region of the transition between the second intermediate storage channel 443 and the delivery channel 445. The slide 480 is arranged exactly in the region where the balls in the position according to FIG. 3*d* are in the region between the second intermediate storage channel 443 and the delivery channel 445.

When the slide 480 is closed, as shown in FIG. 10*b*, the ball cannot leave the delivery channel 445 through a second delivery opening 447, which is closed by the slide 480, but must follow the delivery channel 445 and leave through the first delivery opening 446. The metering dispenser according to FIG. 10*a, b* is therefore configured, when the slide is closed, for delivery of a product on movement from the second into the first position according to FIG. 3*a-e*.

However, when the slide is opened, as shown in FIG. 10*a*, the product can leave the region between the second intermediate storage channel 443 and the delivery channel 445 through the second delivery opening 447. The product is therefore, referring to FIGS. 3*a-e*, already delivered on movement of the metering dispenser from the first position, shown in FIG. 3*b*, into the second position, shown in FIG. 3*c*. In the configuration with the slide opened shown in FIG. 10*a*, the metering dispenser according to FIG. 10*a, b* therefore functions like the embodiment described with reference to FIGS. 2*a-c* and delivers a product through the second delivery opening 447 on movement of the metering dispenser from the first into the second position.

FIGS. 11*a, b* show a variant of the embodiment according to FIG. 10*a, b*. In this variant, the slide 580 is arranged in the region between the second intermediate storage channel 543 and the delivery channel 545 and closes a second delivery opening 547, which is constructed in the dividing wall between the second intermediate storage channel 543 and the delivery channel 545. When the slide 580 is opened, as shown in FIG. 11*a*, the product is delivered through the first delivery opening 547 on movement of the metering dispenser from the first into the second position.

Figure 11B:
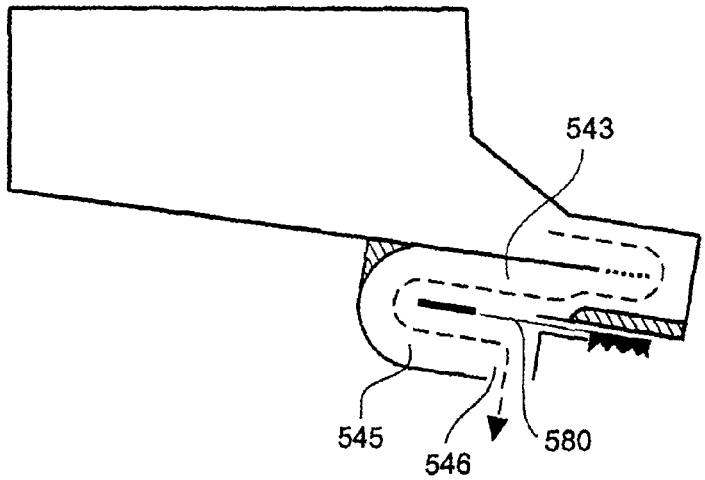

When the slide 580 is closed, as shown in FIG. 11*b*, the product passes the closed opening 547 on movement of the metering dispenser from the first into the second position and is delivered through the first delivery opening 546 on movement of the metering dispenser from the second into the first position.

In the embodiment shown in FIG. 11*a, b*, the delivery channel 545 is somewhat shorter compared with the embodiment according to 10*a, b* for the purpose of unobstructed release of the product from the second delivery opening 547 when the slide 580 is opened.

Referring now to FIGS. 12*a-c*, a variant of the delivery device of the metering dispenser according to the invention is shown in which in each case two product balls are delivered from the metering dispenser in one delivery operation. The embodiment shown comprises a intermediate storage channel 641, which can be the intermediate storage channel of the embodiment according to FIG. 2 or the first intermediate storage channel of the embodiment according to FIG. 3. The intermediate storage channel 641 is connected via a gap 651, which is larger than the product dimensions, to a channel 643, which can serve as a delivery channel according to FIG. 2 or as a second intermediate storage channel according to FIG. 3.

In contrast to the embodiments explained hitherto, in the embodiment according to FIGS. 12*a-c* the second channel 643 is high enough for the first ball 631 to be able to enter completely into the second channel and for the following ball 632 to be able to roll on into the region of the gap 651. By this means, the mutual blocking, which is desired in the embodiments described above, of the balls by on the one hand the section of the first ball projecting into the intermediate storage channel and on the other hand the section of the second ball projecting into the delivery channel is avoided in the embodiment according to 12*a-c*.

When the delivery region according to 12*a-c* is moved from the first position, shown in FIG. 12*b*, into the second position, shown in FIG. 12*c*, the ball 631 can roll directly along the second channel 643 and thus renders is possible for the ball 632 to enter into the second channel 643, so that this ball 632 does not roll back into the product store like the other balls. The ball 632 follows the ball 631 and is delivered (if the delivery device is otherwise constructed in accordance with 2*a-c*) or arrives in the region between the intermediate storage channel and the delivery channel (in the embodiment of the further delivery device according to FIG. 3*a-e*).

In this manner, on movement of the metering dispenser from the first into the second position or, respectively, from the second into the first position, in each case exactly two pre-portioned products are delivered.

FIGS. 13*a-d* show a second embodiment for delivery of two balls. In this embodiment, the gap 751 between the intermediate storage channel 741 and the second channel 743 is constructed as in the embodiments described with reference to FIGS. 1-11. However, the height of the second channel 743 is such that the first ball 731 does not prevent the second ball 732 from rolling further, so that this second ball 732 can arrive in an extension 748 of the intermediate storage channel 741 constructed as a dead-end. In the first position of the metering dispenser, an arrangement of the balls according to FIG. 13*c* therefore results. When the metering dispenser moves from this first position into the second position, the second ball 732 displaces the third ball 733, so that this third ball 733 rolls back into the intermediate store. The second ball 732, on the other hand, falls through the gap 751 and follows the first ball 731 through the second channel, that is to say through the delivery channel, or, respectively, to the intermediate store in the region between the second intermediate storage channel and the delivery channel.

FIGS. 14*a-c* show a further development of the embodiment according to FIG. 13*a-e*. In this embodiment, the length of the dead-end region 848 is limited by a variable slide 890. Depending on the position of the variable slide 890, the dead-end region 848 can accommodate one, two or more balls. The balls accommodated in the dead-end region 848 all follow the first ball 831, so that a metered release of any desired number of balls can be achieved in each delivery operation and the number of balls to be metered can be adjusted via the slide 890.

FIG. 15 shows a modified embodiment of the embodiment according to FIGS. 14*a-c*. In this embodiment, the slide 990 is provided with a clamp underneath the dead-end region 948. The mode of functioning of the embodiment according to FIG. 15 is otherwise similar to that according to FIG. 14*a-c*.

Referring now to FIGS. 16, 17*a, b*, a seventh embodiment of the invention is shown, in which the storage container overall is constructed approximately triangular in cross-section, the base area 1023 of the storage container serving for fixing to the WC lid. The storage container of the metering dispenser according to the invention can be of diverse construction in respect of its geometry. In particular, in many embodiments forms which are rounded off in cross-section compared with the approximately triangular shape, such as, for example, elliptical, semicircular or circular construction shapes, are advantageous. An essential feature of the cross-section is a storage volume provided by the cross-section and the possibility of collecting the products at a low point or region of the container.

The ball guide with intermediate storage channel and delivery channel and optionally second intermediate storage channel is constructed on one of the two side faces 1024 of the storage container. This ball guide on the side has a number of advantages.

Thus, the natural gradient given by the angled arrangement of the side wall of the storage container is utilized for arrangement of the intermediate storage and delivery channel in a manner arranged one above the other relative to the direction of gravity.

The embodiment according to FIGS. 16, 17*a, b* also has the advantage that a visually pleasing construction is realized with which, if the walls of the ball guide are constructed from transparent material, an interestingly striking following of the path of the balls by the user of the device is possible.

The embodiment furthermore has the advantage that one side of the storage container, for example that on which the ball guide is not attached, can be constructed as a refill container which can be retrofitted and can be connected to the remainder of the device.

The ball guide can also be formed directly in the side wall of the container and can thus be a constituent of the refill pack, together with the storage container shaped thereon.

A further advantage of this embodiment is that a space-saving arrangement of several intermediate storage channels is rendered possible by the arrangement on the side. This improves the late delivery of the product, which is often problematic with openers and, especially when the storage container is full, often only takes place when the WC lid is almost completely open if only one intermediate storage channel is provided. However, if several intermediate channels, for example three, are present, the product can already be delivered at small opening angles.

The arrangement of the channels on the side furthermore allows an overall flat construction and thereby avoids too high a construction of the metering dispenser, that is to say a projection too far from the WC lid, especially if several channels are present. On the one hand, this could have the disadvantage that the metering dispenser is wetted by splashed water with the lid closed, and on the other hand a user can be caught with his clothing on the metering dispenser when the lid is open or can be troubled by this.

Figure 17B:
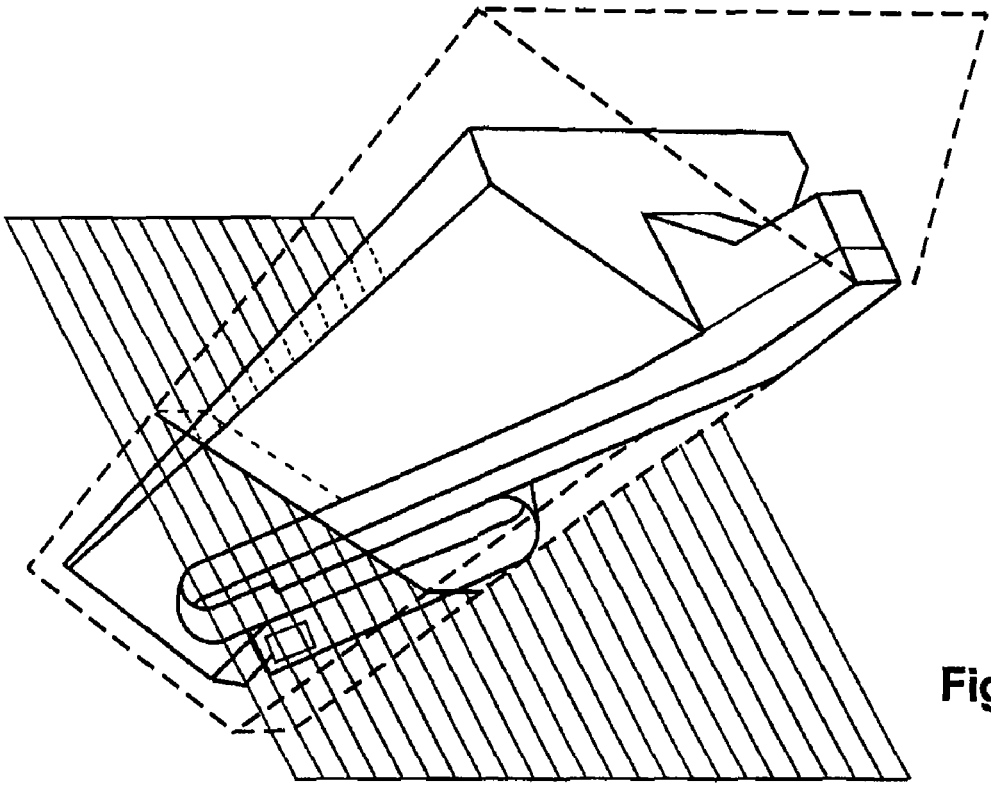

FIG. 17*a* shows, in a cross-section according to FIG. 17*b*, the arrangement of the track levels of the ball guide 1040 stacked vertically relative to one another. An embodiment which functions as an opener is shown, like the embodiment according to FIG. 2*a-c*, the embodiment according to FIG. 17*a, b* having three intermediate storage regions.

Finally, FIGS. 18 and 19 show an eighth embodiment of the device according to the invention in which two storage containers separated from one another are provided, which each cooperate with a delivery device. This delivery device can be constructed on the one hand according to the delivery device of FIG. 2 and on the other hand according to the delivery device of FIG. 3. Various delivery modes of the products can be achieved with the embodiment according to FIGS. 18 and 19. Thus, on the one hand two different products can be delivered in each case on opening of the WC lid (from the first into the second position) or in each case on closing of the WC lid (from the second into the first position), by the storage container 1120 being filled with a first product and the storage container 1120' being filled with a second product and the delivery devices 1140 and 1140' in each case both being constructed as "openers" (according to FIG. 2*a-c*) or both being constructed as "closers" (according to FIG. 3*a-c*).

As an alternative to this, with the embodiment according to FIGS. 18 and 19, delivery of the same product in each case on opening or closing of the WC lid can be achieved by the storage containers 1120 and 1120' being filled with the same product and the delivery device 1140 of the storage container 1120 being constructed as an opener and the delivery device 1140' of the storage container 1120' being constructed as a closer.

Finally, as a further alternative, delivery of different products on opening and on closing can be realized by the storage containers 1120 and 1120' being filled with different products and the delivery device 1104, 1140' being constructed as in the variant described above.

As described above, the pre-portioned products can be made of a material in the solid state of aggregation, or can comprise a shell in a solid state of aggregation enclosing a material in the liquid or gaseous state. For the cleaning, disinfecting and/or fragrance action realized according to the invention, a number of formulations which can be brought into the solid, liquid or gaseous form, and stabilized therein, by appropriate measures in order to serve as the product material, covering material or filling material for products with a covering are known to the person skilled in the art.

Formulation Example 1

| Constituents | Chemical name | Wt. % |
|---|---|---|
| Emuldac AS-25 | Ethoxylate (29EO) of linear alcohol (C16) | 65 |
| Lipoxol 6000 | Polyoxyethylene (12EO) | 14 |
| Marlipal O 13/120 | Polyoxyethylene (12EO) tridecyl ether | 5 |
| Comperlan 100 | N-(2-Hydroxyethyl)-coco-fatty acid amide | 5 |
| Licowax KLE FL | Octacosanoic acid ester with emulsifier | 5 |
| Perfume oil | Perfume oil | 6 |

Formulation Example 2

| Constituents | Chemical name | Wt. % |
|---|---|---|
| Imbentin C/125/200 | Fatty alcohol C12-15 ethoxylate (20EO) | 4 |
| Rewomid C 212 | Coco-fatty acid monoethanolamide | 6 |
| Marlon ARL | Sodium dodecylbenzenesulfonate | 40 |
| Sodium sulfate | Sodium sulfate | 20 |
| Vestinol 9 | Di(isononyl) phthalate | 4 |
| Sodium dichloroisocyanurate dihydrate | Sodium dichloroisocyanurate | 20 |
| Perfume oil | Perfume oil | 6 |

Formulation Example 3

| Constituent/chemical name | Wt. % |
|---|---|
| Sodium cocoyl-isoethionate | 40 |
| Sulfosuccinic acid lauryl ester, disodium salt | 20 |
| Paraffin | 10 |
| Stearic acid | 10 |
| Potato starch | 10 |
| Perfume oil | 5 |
| Dyestuff, water | to 100 |

The invention claimed is:

1. A metering dispenser for release of a product into a WC bowl of a toilet, comprising a fixing region which is constructed in order to fix the metering dispenser in the region of the toilet under a WC lid, and a storage container (20) for accommodating the product, wherein said storage container (20) is constructed for accommodating a plurality of spherical pre-portioned products (30), and a delivery device (41, 43, 51*a, b*), which is constructed in order to deliver at least one of said pre-portioned products from the storage container into said WC bowl, said delivery device including an intermediate storage channel for receiving a plurality of said pre-portioned products when said metering dispenser is tilted in a first direction, said intermediate storage channel having an inlet connected to said storage container for receiving said products and an outlet spaced from said inlet;

a delivery channel having an inlet end communicating with said outlet of said intermediate storage channel and an outlet spaced from said inlet end; and an opening between said intermediate channel and said delivery channel having a dimension to feed a predetermined number of said pre-portioned products by gravity into said inlet end of said delivery channel when said dispenser is tilted in said first direction and where said predetermined number of products in said delivery channel are dispensed by gravity through said delivery channel outlet when said dispenser is tilted in a second direction, and said products in said intermediate channel are retained in said intermediate channel.

2. A metering dispenser according to claim 1, wherein said fixing region is constructed to fix the metering dispenser on a WC lid movably attached on said WC bowl.

3. A metering dispenser according to claim 1, wherein said delivery device (41, 43, 51*a, b*) is constructed to deliver at least one pre-portioned product on movement of a WC lid movably attached on said WC bowl, and movable relative to said WC bowl from a first position into a second position and/or from a second position into a first position.

4. A metering dispenser according to claim 3, wherein said first position corresponds to a closed WC lid and said second position corresponds to an opened WC lid.

5. A metering dispenser according to claim 1, wherein said delivery device is constructed such that in a first position at least one pre-portioned product enters into said delivery device from the storage container under the influence of gravity, and that a predetermined number of pre-portioned products is delivered into said WC bowl under the influence of gravity on movement of said delivery device from said first position into a second position.

6. A metering dispenser according claim 1, wherein said intermediate storage channel is constructed such that in a first position it is at least partly filled with pre-portioned products from said storage container under the influence of gravity, and that the predetermined number of pre-portioned products is delivered into said WC bowl through said delivery channel under the influence of gravity on movement of said delivery device from a first position into a second position.

7. A metering dispenser according to claim 1, wherein said intermediate storage channel comprises:

a first intermediate storage region connected to said storage container and is constructed such that in a first position it is at least partly filled with said pre-portioned products, and a second intermediate storage region connected to said first intermediate storage region and in which at least one pre-portioned product arrives on movement of the delivery device from said first into said second position, and where said delivery channel which is connected to said second intermediate storage region and through which at least one pre-portioned product is delivered on movement of the delivery device from said second to said first position.

8. A metering dispenser according claim 1, wherein said intermediate storage channel comprises:

a first intermediate storage region connected to said storage container and is constructed such that in a first position it is at least partly filled with said pre-portioned products, and a second intermediate storage region connected to said first intermediate storage region and in which a predetermined number of pre-portioned products arrives on movement of said delivery device from said first into said second position, and where a number N of further intermediate storage regions, which are each connected to one another such that on alternating movement of the delivery device between said first and said second position, the predetermined number of pre-portioned products in each case arrives in the next intermediate storage region, and said delivery channel is connected to the last of said N intermediate storage regions and through which the pre-portioned products are delivered on renewed alternating movement of said delivery device, wherein a delivery takes place on movement from the second into the first position for an even number N, and a delivery takes place on movement from said first into said second position for an odd number N.

9. A metering dispenser according to claim 1, further comprising a portioning device for delivery of a predetermined number of the pre-portioned product.

10. A metering dispenser according to claim 9, wherein said portioning device (51*a, b*, 43) is arranged between said intermediate storage channel and said delivery channel and is constructed such that in said first position a predetermined number of said pre-portioned products from said intermediate storage channel enters into the portioning device under the influence of gravity.

11. A metering dispenser according to claim 10, wherein said portioning device comprises a passage region (51*a, b*) with a first section (52*a, b*), through which said pre-portioned product can pass, and is connected to a second section (53*a, b*), through which said pre-portioned product can only partly pass, wherein said first section and said second section are constructed such that a product which has arrived in said delivery channel through said first section prevents a product which has partly passed through said second section from arriving in said delivery channel.

12. A metering dispenser according to claim 11, wherein said first and said second sections are constructed such that a product (32) which has partly passed through said second section prevents a product (31) which has arrived in said delivery channel through said first section from being delivered into said WC bowl.

13. A metering dispenser according to claim 11, wherein said second section (53*a, b*) of said passage region is an opening section which decreases in size continuously from said first section (52*a, b*) or an opening section with a decreased jump in cross-section compared with said first section.

14. A metering dispenser according to claim 11, wherein said intermediate storage channel is constructed, at least in the region of said first and said second sections of said portioning device, as an intermediate storage channel or first intermediate storage channel.

15. A metering dispenser according to claim 11, wherein said delivery channel is constructed, at least in the region of said first and said second sections of the portioning device, as said delivery channel or a second intermediate storage channel.

16. A metering dispenser according to claim 11, wherein said delivery device comprises an intermediate storage section which is connected to said intermediate storage channel and in which a predetermined, preferably adjustable number of pre-portioned products can be intermediately stored.

17. A metering dispenser according to claim 16,
wherein said portioning device comprises an adjusting device for manual adjustment of the number of pre-portioned products to be delivered.

18. A metering dispenser according to claim 16,
wherein said intermediate storage section is constructed as an extension of said intermediate storage channel, the first end of which renders possible entry of pre-portioned products from the intermediate storage channel into said intermediate storage section, and the second end of which is closed by a moving shut-off device.

19. A metering dispenser according to claim 18,
wherein said moving shut-off device can be displaced into several locked-in positions spaced apart from one another, the distance of which from one another approximately corresponds to the product dimension in the longitudinal direction of the intermediate storage section.

20. A metering dispenser according to claim 1, further comprising a component fixed detachably on said delivery device, that is shaped as a product guide channel and is constructed such that
a. when said component is fixed on the delivery device, a pre-portioned product is delivered on movement of the delivery device from a first into a second position, and
b. when said component is not fixed on the delivery device, a pre-portioned product is delivered on movement of the delivery device from the second into a third position.

21. A metering dispenser according to claim 1, further comprising a switching device (480; 580) which cooperates with said delivery device and has
a. a first switch position in which said pre-portioned product is delivered on movement of said delivery device from a first into a second position, and
b. a second switch position in which said pre-portioned product is delivered on movement of said delivery device from said second position into a third position.

22. A metering dispenser according to claim 21,
wherein said switching device (480; 580) comprises a shut-off device which renders possible, in said first position, a delivery of the pre-portioned products from a second intermediate storage region (543), and does not render this delivery possible in the second position.

23. A metering dispenser according to claim 1, wherein said delivery device comprises a manual triggering device and is constructed in order to deliver at least one pre-portioned product when said triggering device is actuated.

24. A metering dispenser according to claim 1, wherein said delivery device is fixed immovably on the metering dispenser.

25. A metering dispenser according to claim 1, wherein at least one section of a wall demarcating the storage container is transparent for the purpose of checking the level of fill.

26. A metering dispenser according to claim 1, wherein the storage container (20) is constructed to accommodate refill magazines with pre-portioned products.

27. A metering dispenser according to claim 1, wherein the pre-portioned products (30; 31-34) are spherical.

28. A metering dispenser according to claim 1, further comprising a second delivery device which a pre-portioned product can be delivered into said WC bowl.

29. A metering dispenser according to claim 28, further comprising a second storage channel which cooperates with said second delivery device.

30. A metering dispenser according to claim 28,
wherein said second delivery device is constructed as a delivery device for delivery of a pre-portioned product from said first storage container taking place on movement of said first delivery device from a first into a second position and a delivery of a pre-portioned product from said second storage container taking place on movement of the second delivery device from said second position into said first position.

31. A refill magazine for accommodating pre-portioned products for the metering dispenser according to claim 1,
wherein the refill magazine comprises fixing means for fixing in a metering dispenser.

32. A lid (101) for a toilet, said lid comprising
said metering dispenser of claim 1 at least partly integrated in said lid.

33. A toilet (100), comprising said metering dispenser of claim 1 at least partly integrated therein.

34. The dispenser of claim 1,
wherein said opening between said intermediate channel and said delivery channel includes means to prevent said products in said intermediate channel from falling through said outlet of said intermediate channel when said predetermined number of products are received in said inlet end of said discharge channel.

35. The dispenser of claim 34, wherein
said means comprises a slot between said intermediate channel and said delivery channel, said slot being contiguous with said opening between said intermediate channel and delivery channel, said slot having a width less than a width of said opening and a width less than an outer dimension of said products.

36. The dispenser of claim 35, wherein
said slot has parallel side edges.

37. The dispenser of claim 35, wherein
said slot has converging side edges.

38. The dispenser of claim 1, wherein said spherical pre-portioned products have a dimension in the range of 4 to 25 mm.

39. A method for the hygienic treatment of toilets, comprising releasing an active compound from a storage container into the WC bowl, wherein the active compound is stored in the storage container in the form of pre-portioned products, and is delivered into the WC bowl in a predetermined number of products from the storage container by means of a delivery device, wherein during each opening of a lid for the toilet, an intermediate storage channel receives a plurality of said pre-portioned products from said storage container, wherein a predetermined number of said pre-portioned products fed by gravity into an inlet end of a delivery channel and during each closing of the lid, said predetermined number of said pre-portioned products is dispensed through an outlet of said delivery channel.

40. A method according to claim 39, wherein during each opening and/or closing or a successive opening and closing or a successive closing and opening of a lid for the toilet, the products are released under the influence of gravity from a metering dispenser arranged on the WC lid.

41. A metering dispenser for dispensing a solid product into a toilet bowl; said dispenser comprising:
a fixing member for fixing the dispenser under a lid in the toilet bowl;
a storage container for storing a plurality of the solid products, said solid products being a unit dosage for dispensing into said toilet bowl, said storage container having an outlet for said products; and
a delivery device comprising:
a first intermediate channel having an inlet for receiving said products, and an outlet at the end opposite said inlet;
a delivery channel having an inlet and an outlet, a passage between said outlet of said first intermediate channel and said inlet of said delivery channel for directing a predetermined number of said products from said storage container through said first intermediate channel to said delivery channel when said dispenser is moved to a first position, and said predetermined number of products in said delivery channel are dispensed through said outlet when said dispenser is moved to a second position, and a portioning device between said intermediate channel and said delivery channel, said portioning device having a first section allowing a first of said products to pass through said opening and a second section allowing a second of said product to partially extend into said delivery channel to prevent said first of said products from being discharge from said delivery channel through said outlet.

42. The dispenser of claim 41, wherein said solid products are balls or tablets of a predetermined dosage.

43. The dispenser of claim 41, wherein said second section of said portioning device defines a slot having a width less than a width of said product.

44. The dispenser of claim 43, wherein said slot has diverging side edges extending toward said opening.

45. A metering dispenser for dispensing a solid product into a toilet bowl; said dispenser comprising a fixing member for fixing the dispenser under a lid in the toilet bowl;

a storage container for storing a plurality of spherical or tablet shaped solid products, said solid products being a unit dosage for dispensing into said toilet bowl, said storage container having an outlet for said products; and a delivery device comprising:

a first intermediate channel having a longitudinal dimension with a first end and a second end, an inlet at said first end for receiving said products from said storage container, and an outlet spaced from said second end defining an extension section for receiving one or more of said products;

a delivery channel having an inlet and an outlet, a passage between said outlet of said first intermediate channel and said inlet of said delivery channel for directing said products from said extension section of said first intermediate channel to said delivery channel when said dispenser is moved to a first position and said products in said delivery channel are dispensed through said outlet when said dispenser is moved to a second position.

46. The dispenser of claim 45, wherein said extension has a movable member to adjust the dimension of said extension to receive a predetermined number of said products.

47. The dispenser of claim 46, wherein said movable member is a slidable member.

48. A metering dispenser for dispensing a predetermined number of spherical or tablet shaped solid products into a toilet bowl, said dispenser comprising:

a fixing member for fixing the dispenser under a toilet bowl lid;

a first storage container for storing a plurality of said products and having an outlet;

a first delivery device connected to said outlet of said first storage container for delivering at least one product to the toilet bowl when said dispenser is moved from a first position to a second position;

a second storage container for storing a plurality of said products and having an outlet; and a second delivery device connected to said outlet of said second storage container for delivering at least one product to the toilet bowl when said dispenser is moved from the second position to the first position.

* * * * *